US011638511B2

(12) United States Patent
Baertsch et al.

(10) Patent No.: US 11,638,511 B2
(45) **Date of Patent: *May 2, 2023**

(54) FLOOR CLEANING APPARATUS WITH OFFSET CLEANING UNIT

(71) Applicant: Diversey, Inc., Fort Mill, SC (US)

(72) Inventors: Andre Baertsch, Rossrueti (CH); Peter Gehrig, Buetschwil (CH); Philipp Jaehde, Aadorf (CH)

(73) Assignee: Diversey, Inc., Fort Mill, SC (US)

( * ) Notice: Subject to any disclaimer, the term of this patent is extended or adjusted under 35 U.S.C. 154(b) by 892 days.

This patent is subject to a terminal disclaimer.

(21) Appl. No.: 16/531,409

(22) Filed: Aug. 5, 2019

(65) Prior Publication Data

US 2019/0365183 A1 Dec. 5, 2019

Related U.S. Application Data

(63) Continuation of application No. 15/515,855, filed as application No. PCT/US2015/053780 on Oct. 2, 2015, now Pat. No. 10,368,709.

(Continued)

(51) Int. Cl.

| | |
|---|---|
| ***A47L 11/293*** | (2006.01) |
| ***A47L 11/40*** | (2006.01) |
| ***A47L 11/30*** | (2006.01) |

(52) U.S. Cl.

CPC ..... *A47L 11/293* (2013.01); *A47L 11/305* (2013.01); *A47L 11/4013* (2013.01);

(Continued)

(58) Field of Classification Search

CPC .. A47L 11/293; A47L 11/305; A47L 11/4013; A47L 11/4038; A47L 11/4044;

(Continued)

(56) References Cited

U.S. PATENT DOCUMENTS

| | | | |
|---|---|---|---|
| 4,173,056 | A | 11/1979 | Geyer |
| 4,831,684 | A | 5/1989 | Duncan |

(Continued)

FOREIGN PATENT DOCUMENTS

| | | | |
|---|---|---|---|
| DE | 2241901 | A1 | 3/1974 |
| DE | 9115578 | U1 | 2/1992 |

(Continued)

OTHER PUBLICATIONS

Communication dated Mar. 7, 2019 from the European Patent Office Examining Division including search results under rule 164(2)(b) EPC of counterpart European Patent Application 15778586.6, dated Oct. 2, 2015, publication No. EP3200667.

(Continued)

*Primary Examiner* — David Redding
(74) *Attorney, Agent, or Firm* — Andrew R. Aranda, Chief IP Counsel

(57) ABSTRACT

An apparatus for cleaning a floor includes a housing, wheels by which the apparatus is adapted to move; a motive device for moving the apparatus, a steering mechanism, and a cleaning assembly including a cleaning unit and an offset mechanism adapted to move the cleaning unit to or from an offset position projecting beyond one lateral side of the apparatus. In another embodiment, an apparatus for cleaning a floor includes a housing, wheels by which the apparatus is adapted to move, a motive device for moving the apparatus, a steering mechanism, and a cleaning assembly including a cleaning unit and a swing mechanism indirectly linking the cleaning unit to the steering mechanism such that when the apparatus is in an operative mode, the cleaning unit reorients its position in synchronization with the path of travel of the apparatus. Optionally, a lifting device may raise and lower the cleaning assembly.

22 Claims, 18 Drawing Sheets

Related U.S. Application Data

(60) Provisional application No. 62/058,737, filed on Oct. 2, 2014.

(52) U.S. Cl.
CPC ..... *A47L 11/4038* (2013.01); *A47L 11/4044* (2013.01); *A47L 11/4061* (2013.01); *A47L 11/4072* (2013.01)

(58) Field of Classification Search
CPC ..... A47L 11/4061; A47L 11/4072; A47L 11/4055
See application file for complete search history.

(56) References Cited

U.S. PATENT DOCUMENTS

| | | | |
|---|---|---|---|
| 4,854,005 | A | 8/1989 | Wiese et al. |
| 6,023,813 | A | 2/2000 | Thatcher et al. |
| 6,163,923 | A | 12/2000 | Hefter |
| 6,212,731 | B1 | 4/2001 | Eckerlein et al. |
| 10,368,709 | B2 * | 8/2019 | Baertsch ..... A47L 11/4044 |
| 2005/0223514 | A1 | 10/2005 | Stuchlik et al. |
| 2006/0064844 | A1 | 3/2006 | Venard et al. |
| 2011/0107529 | A1 | 5/2011 | Hetler |
| 2011/0289700 | A1 | 12/2011 | Chignoli |
| 2013/0212814 | A1 | 8/2013 | Shinler et al. |
| 2016/0353958 | A1 | 12/2016 | Vetse |

FOREIGN PATENT DOCUMENTS

| | | | |
|---|---|---|---|
| EP | 0269632 | B1 | 1/1992 |
| FR | 1271628 | A | 9/1961 |
| WO | 2010/084030 | A1 | 7/2010 |

OTHER PUBLICATIONS

International Search Report and Written Opinion of counterpart PCT/US2015/053780 dated Feb. 29, 2016; 14 pages.

EP Notice of Intention to Grant counterpart EP Application 15778586.6 dated Dec. 11, 2019.

* cited by examiner

FLOOR CLEANING APPARATUS WITH OFFSET CLEANING UNIT

CROSS-REFERENCE TO RELATED APPLICATION

This application claims the benefit of and priority to U.S. patent application Ser. No. 15/515,855 filed Mar. 30, 2017, issued as U.S. Pat. No. 10,368,709, the entire content of which is hereby incorporated by reference.

FIELD OF THE INVENTION

This invention relates to a floor cleaning apparatus with a cleaning unit that can be offset, and to a method for cleaning a floor.

BACKGROUND OF THE INVENTION

Various powered floor cleaning machines are known in the art, including those in which the operator is standing on the floor and walking behind the machine ("walk-behind" machines), those in which the operator is sitting on the machine ("ride-on" machines), and those in which the operator is standing on the machine ("stand-on" machines).

Ride-on machines are common in the market for cleaning larger areas.

The marketplace desires on the one hand a floor cleaning machine that is capable of cleaning close to a wall, shelf or other boundary area. Fulfilling this need requires that the apparatus have a considerable offset of the cleaning unit, i.e. that the effective cleaning reach of the cleaning assembly of the apparatus extend from the basic footprint of the apparatus itself so that the edges of the floor can be cleaned.

Another desire of the marketplace is a floor cleaning machine that is capable of passing through relatively narrow slots or spaces, e.g. the "check-out" area of a store or other industrial or commercial building, or the narrow entrances to service areas of a building.

Efforts have been made to address these requirements.

One approach is to provide a floor cleaning machine with a cleaning unit with a variable working width. In normal operation, a large working width is employed, but a narrower width can be used that permits the machine to pass through relatively narrow slots or spaces, e.g. check-out areas when needed. Unfortunately, such a system is accompanied by several disadvantages. The mechanical elements of the variable working width cleaning unit are susceptible to exposure to dirt and water; the system is complex; and accessibility for purposes of maintenance is poor. This can lead to a cleaning apparatus with relatively low reliability, and relatively high investment and maintenance costs.

Another need in the marketplace is to link the cleaning unit to the steering mechanism of the machine. One commercial approach has been to attach a cleaning unit directly to the steering axle of the steering mechanism so that turning a steering wheel also turns the cleaning unit. One disadvantage of this approach is that it offers no capability to incorporate a transition ratio between the degree of turn of the steering wheel, and the degree of turn of the cleaning unit.

It would be desirable to have available a floor cleaning machine that provides an offset cleaning mode that offers the capability of cleaning edge areas close to walls, etc., but also a non-offset cleaning mode that enables the machine to pass through relatively narrow slots or spaces.

It would be desirable to have available a floor cleaning machine that provides a mechanism that links the cleaning unit to the steering mechanism of the machine, so that the cleaning unit reorients its position in synchronization with the path of travel of the apparatus, and offers the capability to incorporate a transition ratio between the degree of turn of the steering wheel, and the degree of turn of the cleaning unit.

It would be desirable to have available a floor cleaning machine that provides both an offset and non-offset cleaning mode, while at the same time providing a mechanism that links the cleaning unit to the steering mechanism of the machine.

It would be also be desirable in some cases to have available a floor cleaning machine that additionally provides a cleaning unit with the capability, whether in the off-set cleaning mode or non-offset cleaning mode, of moving in response to contact with an obstacle.

It would be additionally desirable in some cases to have available a floor cleaning machine that does not require a cleaning unit with a variable working width, but instead provides a cleaning unit with a fixed working width.

SUMMARY OF THE INVENTION

In a first aspect, a floor cleaning apparatus for cleaning a floor, the apparatus adapted to traverse a path of travel, comprises a housing, a plurality of wheels by which the floor cleaning apparatus is adapted to move across the floor in a direction of travel, the direction of travel at least partially defining a front end, a back end, and first and second lateral sides of the floor cleaning apparatus, a motive device for moving the apparatus across the floor, a steering mechanism, and a cleaning assembly for cleaning the floor. The cleaning assembly comprises a cleaning unit and an offset mechanism adapted to move the cleaning unit to or from an offset position.

In a second aspect, a method for cleaning a floor comprises providing a floor cleaning apparatus for cleaning a floor, the apparatus adapted to traverse a path of travel, comprising a housing, a plurality of wheels by which the floor cleaning apparatus is adapted to move across the floor in a direction of travel, the direction of travel at least partially defining a front end, a back end, and first and second lateral sides of the floor cleaning apparatus, a motive device for moving the apparatus across the floor, a steering mechanism, and a cleaning assembly for cleaning the floor. The cleaning assembly comprises a cleaning unit, and an offset mechanism adapted to move the cleaning unit to or from an offset position. The method for cleaning the floor further comprises navigating the apparatus across the floor while cleaning the floor.

In a third aspect, a floor cleaning apparatus for cleaning a floor, the apparatus adapted to traverse a path of travel, comprises a housing, a plurality of wheels by which the floor cleaning apparatus is adapted to move across the floor in a direction of travel, the direction of travel at least partially defining a front end, a back end, and first and second lateral sides of the floor cleaning apparatus, a motive device for moving the apparatus across the floor, a steering mechanism, and a cleaning assembly for cleaning the floor. The cleaning assembly comprises a cleaning unit and a swing mechanism linking the cleaning unit to the steering mechanism, at a pivot wheel spaced from the steering mechanism, such that when the floor cleaning apparatus is in an operative mode, the cleaning unit reorients its position in synchronization with the path of travel of the floor cleaning apparatus.

In a fourth aspect, a method for cleaning a floor comprises providing a floor cleaning apparatus for cleaning a floor, the apparatus adapted to traverse a path of travel, comprising a housing, a plurality of wheels by which the floor cleaning apparatus is adapted to move across the floor in a direction of travel, the direction of travel at least partially defining a front end, a back end, and first and second lateral sides of the floor cleaning apparatus, a motive device for moving the apparatus across the floor, a steering mechanism, and a cleaning assembly for cleaning the floor. The cleaning assembly comprises a cleaning unit and a swing mechanism linking the cleaning unit to the steering mechanism, at a pivot wheel spaced from the steering mechanism, such that when the floor cleaning apparatus is in an operative mode, the cleaning unit reorients its position in synchronization with the path of travel of the floor cleaning apparatus. The method for cleaning the floor further comprises navigating the apparatus across the floor while cleaning the floor.

In a fifth aspect, a floor cleaning apparatus for cleaning a floor, the apparatus adapted to traverse a path of travel, comprises a housing, a plurality of wheels by which the floor cleaning apparatus is adapted to move across the floor in a direction of travel, the direction of travel at least partially defining a front end, a back end, and first and second lateral sides of the floor cleaning apparatus, a motive device for moving the apparatus across the floor, a steering mechanism, and a cleaning assembly for cleaning the floor, and a lifting device adapted to selectively raise and lower the cleaning assembly. The cleaning assembly comprises a cleaning unit, an offset mechanism adapted to move the cleaning unit to or from an offset position, and a swing mechanism linking the cleaning unit to the steering mechanism, such that when the floor cleaning apparatus is in an operative mode, the cleaning unit reorients its position in synchronization with the path of travel of the floor cleaning apparatus.

BRIEF DESCRIPTION OF THE DRAWINGS

The present invention is illustrated by reference to the following drawing figures wherein.

DEFINITIONS

Figure 1:
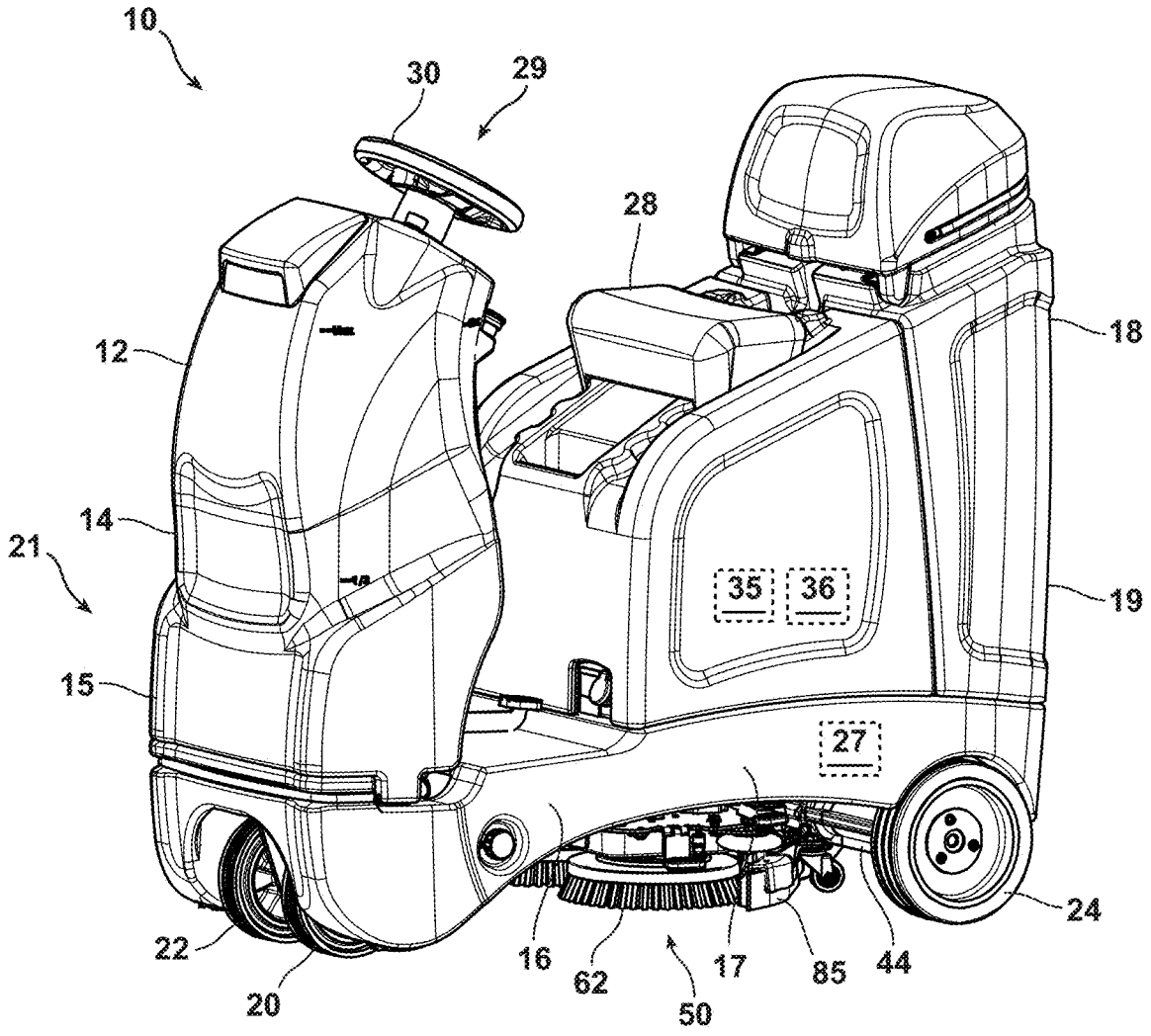
FIG. 1 is a perspective view of a floor cleaning apparatus.

"Cleaning" and the like herein refers to treating a floor; in one embodiment, this involves the use of a cleaning fluid and at least one brush, but alternatively or additionally refers to any of burnishing, polishing, vacuuming, sweeping, or brushing, with or without a cleaning fluid, or otherwise affecting the condition of, a floor.

"Offset" and "offset mode" and the like herein refer to a position of the cleaning unit, and to a cleaning mode, in which the cleaning unit is configured to project sufficiently beyond one lateral side of the floor cleaning apparatus to effect cleaning of areas of the floor, e.g. edge areas, beyond a lateral side of the floor cleaning apparatus per se, i.e. beyond the footprint of the apparatus per se. "Non-offset" and "non-offset mode" and the like herein refers to a position of the cleaning unit, and a cleaning mode in which the cleaning unit is configured not to project significantly beyond either lateral side of the floor cleaning apparatus per se, i.e. not significantly beyond the footprint of the apparatus per se. The floor cleaning apparatus disclosed herein is configured to operate selectively in either an offset or non-offset cleaning mode.

"Fixed working width" with respect to the cleaning unit herein means that the working width of the cleaning unit itself, i.e. the width of the portion of the unit that effects cleaning, remains constant whether the apparatus is in an offset mode or non-offset mode.

"Operative mode" and the like herein refers to a mode in which the cleaning unit is activated.

"Navigational mode" and the like herein refers to a mode in which the floor cleaning apparatus is traversing a floor surface, with the cleaning unit either activated or deactivated.

DETAILED DESCRIPTION OF THE INVENTION

The drawings illustrate the configuration and operation of a floor cleaning apparatus 10 in accordance with the invention. Apparatus 10 includes a housing 12. In one embodiment, housing 12 includes a forward component 14, an intermediate component 16, and a rearward component 18.

Apparatus 10 is adapted to move across the floor in a direction of travel, the direction of travel at least partially defining, in one embodiment, a front end 15, a back end 19, and first, left 17 and second, right 21 lateral sides of the apparatus.

Apparatus 10 traverses the floor by means of a plurality of wheels. In one embodiment, the apparatus can include two front wheels, i.e. left front wheel 20 and right front wheel 22 connected by a front axle 42, and two rear wheels, i.e. left rear wheel 24 and right rear wheel 26 connected by a rear axle 44. The two front wheels 20, 22 can be spaced apart a distance equal to the distance between the two rear wheels 24, 26. Alternatively, the front wheels 20, 22 can be spaced apart a distance greater than, or less than, the distance between the two rear wheels 24, 26. Alternatively, the apparatus can have a single front wheel and a pair of rear wheels; or a pair of front wheels and a single rear wheel. The apparatus includes at least one drive wheel. Any or all of the wheels can be drive wheels, and the apparatus can include one or more caster or free wheels. The plurality of wheels by which the floor cleaning apparatus is adapted to move across the floor in a direction of travel, can include one or more drive wheels, such as a pair of driving wheels for moving the body, a motor, such as an electric motor, for directly or indirectly driving the wheel or wheels, and steering and speed control members for operating the driving motor. Steering may either be manual or by way of differentiated control of individual wheel speeds.

Apparatus 10 includes a motive device 27 (such as at least one motor, not explicitly shown) for moving the apparatus 10 across the floor. Drive wheels can be connected to and powered by electric motors indirectly by e.g. a belt or a chain, but other connections can also be used, e.g., the wheels can be individually powered by hub motors.

Figure 2:
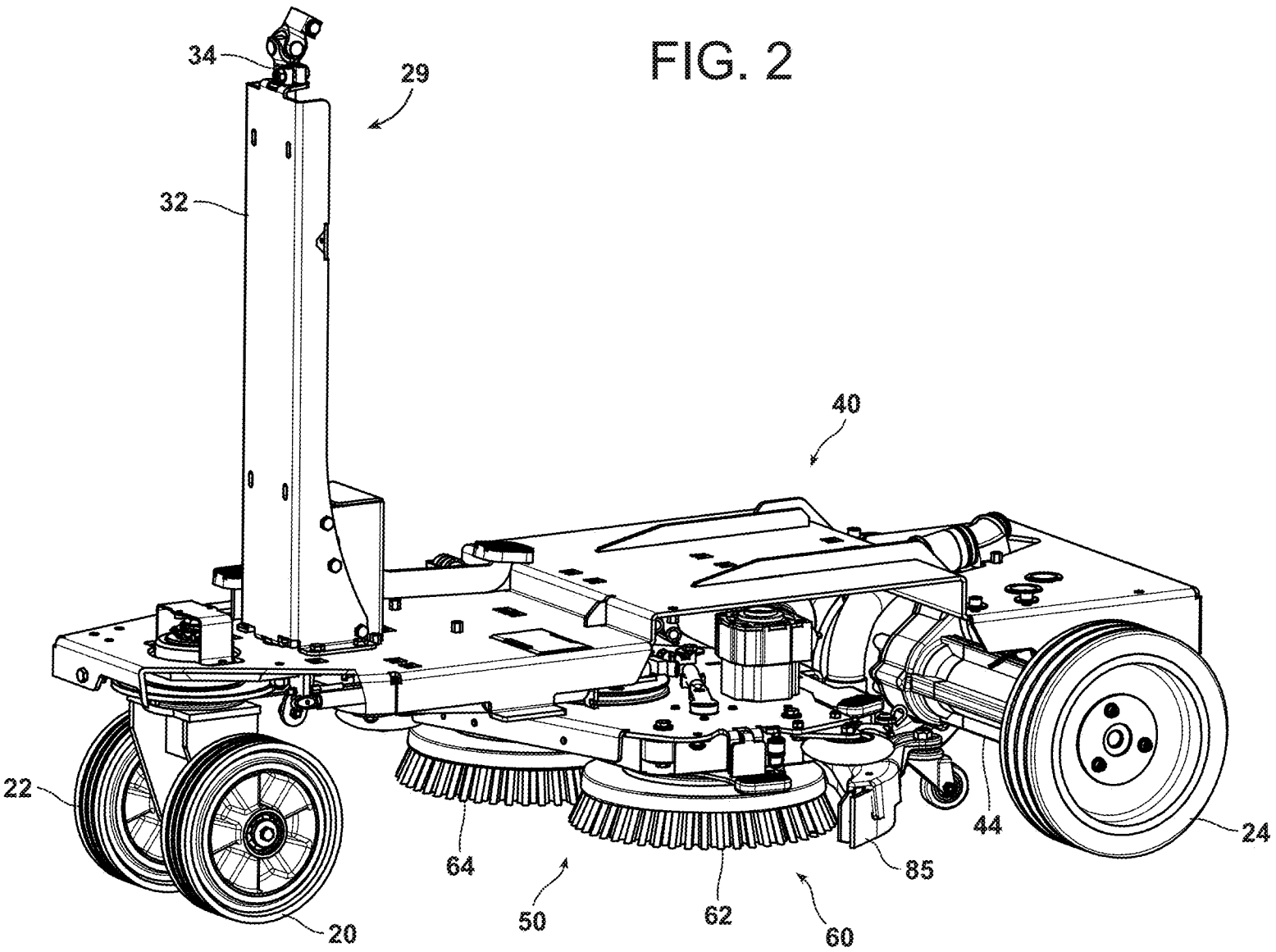
FIG. 2 is a perspective view of a portion of a floor cleaning apparatus.

Apparatus 10 includes a steering mechanism 29, which can include a conventional steering wheel 30. Instead of a steering wheel, mechanism 29 can have other configurations; for example, the apparatus 10 can comprise two hand gears or levers, one for each front wheel, which are pulled forward or backward, etc. Steering mechanism 29 also includes the appropriate steering linkage 34 (see FIGS. 2 & 3) to operationally couple e.g. the steering wheel 30 to the wheels 20, 22 used to guide the path of the floor cleaning apparatus 10; as well as a steering housing 32 to accommodate the steering linkage 34. Steering mechanism 29 can also include a user interface or dashboard. Steering can be controlled by the front wheel or wheels 20, 22, or by the back wheel or wheels 24, 26.

Apparatus 10 includes a cleaning assembly 50 for cleaning the floor. Cleaning assembly 50 includes a cleaning unit 60. In one embodiment, cleaning unit 60 comprises a brush assembly. Cleaning unit 60 can include one or more brushes, such as a circular brush or brushes, suitably powered by an electric motor or other motive device to turn the brushes when the apparatus is in cleaning mode. In one embodiment, cleaning unit 60 includes a left brush 62 and a right brush 64. In one embodiment, these brushes operate to rotate in opposite directions so as to maximize the scrubbing function while moving soil and spent liquid toward a region under the machine where an optional squeegee/vacuum 85 can pick up the spent liquid from the floor. The brushes can be of any suitable material, size, shape, and bristle density and pattern. In one embodiment, brushes 62 and 64 are offset from each other with respect to the longitudinal centerline of the floor cleaning apparatus; i.e. a brush centerline running through the center of the two brushes is in one embodiment not perpendicular to the longitudinal center line of the apparatus, or is not transverse to the direction of travel of the apparatus during operation. Such an arrangement minimizes the lateral extent of the cleaning unit, when operating in non-offset mode, to control the lateral extent of the apparatus, and so that the apparatus 10 can pass through relatively narrow slots, spaces or passageways.

Alternatively or additionally, the cleaning unit 50 can comprise a brush assembly in combination with a dispenser for dispensing a cleaning solution onto the floor; a burnishing device; a polishing device; a sweeping device; a vacuum device; or any suitable combination of the above.

Figure 5:
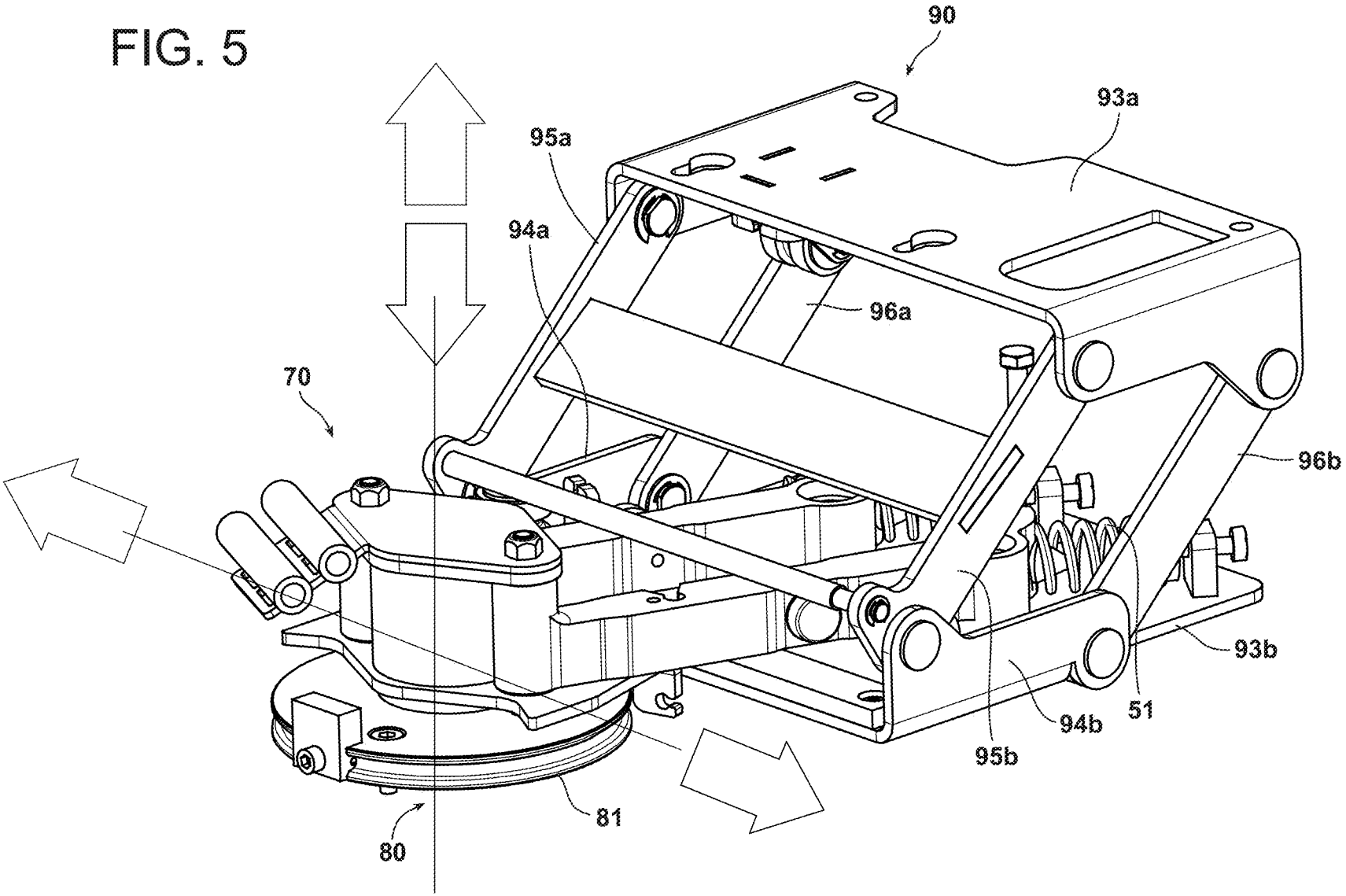
FIG. 5 is a perspective view of a lifting device and offset mechanism.

Cleaning assembly 50 also includes in one embodiment an offset mechanism 70 adapted to move the cleaning unit to or from an offset position. As shown in FIG. 5, offset mechanism 70 enables the cleaning unit to move from a non-offset position and cleaning mode to an offset position and cleaning mode, or from an offset position and cleaning mode to a non-offset position and cleaning mode. The floor cleaning apparatus disclosed in this embodiment is configured to operate selectively in either an offset or non-offset cleaning mode. The horizontal arrows of FIG. 5 represent the field of motion of offset mechanism 70. Offset mechanism 70 is supported within the framework of lifting device 90. The shifting or moving action of offset mechanism 70 can be accomplished mechanically or electrically. For instance, mechanical actuation might occur via a suitable manual shifting device, (e.g. by suitable linkage to a food pedal such a pedal 92, see FIG. 3, or to a hand-operated lever). In an embodiment illustrated in FIG. 3, pushing down on and then releasing the foot pedal 92 activates the offset mechanism 70 to move the mechanism, and thus the cleaning unit 60, from a non-offset position and mode to an offset position and mode. Repeating this action moves mechanism 70, and thus the cleaning unit 60, from the offset position and mode back to the non-offset position and mode. Similarly, in embodiments not explicitly shown, the offset mechanism 70 might be actuated electronically by the operator activating a button, switch, touch panel or other input device to actuate a DC or AC motor such as a servomotor or a linear motor. A motor (not shown) can move the cleaning unit 60 to and from the offset position with less physical input from an operator. This offset movement can be accomplished when the cleaning unit 60 is in a lower or operative position (e.g. when a brush assembly is in contact with the floor) or when the cleaning unit 60 is in a raised or non-operative position (e.g. when a brush assembly is not in contact with the floor). This latter configuration of the apparatus may occur e.g. when the apparatus is being navigated from one location to another.

The cleaning unit 60 in one embodiment includes a biasing member 51, such as one or more springs (see FIGS. 5 and 6) that facilitates movement of the offset mechanism 70 and thus cleaning unit 60 to and from an offset position. When the apparatus is operating in an offset position and mode, and the cleaning unit bumps into an obstacle (wall, etc.), the mechanism 70 and cleaning unit 60 will move toward a non-offset position, effectively moving toward the underside of the apparatus; after engagement with the obstacle has discontinued, mechanism 70 and cleaning unit 60 return to their offset position with the assistance of the one or more biasing members 51. One or more edge wheels 52 are situated along the peripheral edges of the cleaning unit 60. The edge wheels 52, in combination with the biasing member(s) 51, serve to minimize damage to the cleaning unit 60 and/or any obstacles since the wheels 52 will roll along the surface of an obstacle while the cleaning unit 60 moves towards the underside of the apparatus 10 under the force of any impact.

Figure 4:
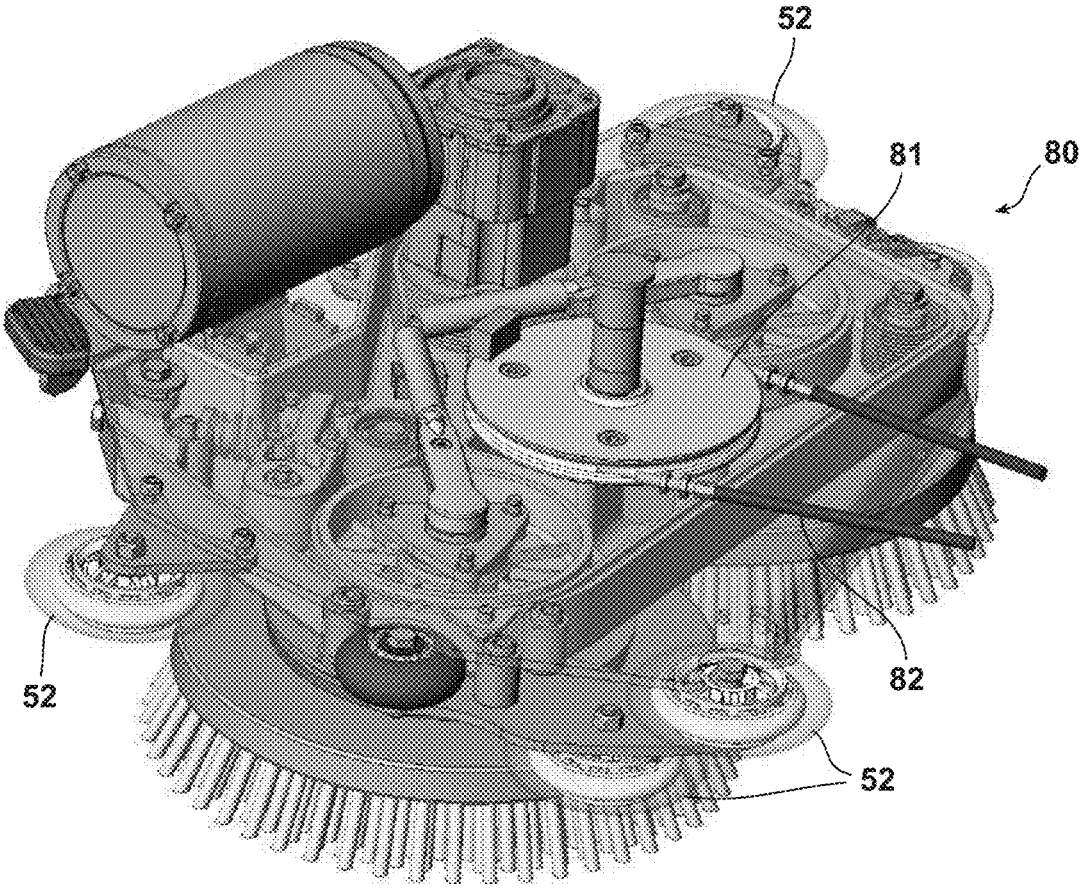
FIG. 4 is a perspective view of a portion of a cleaning assembly.

Cleaning assembly 50 includes in one embodiment a swing mechanism 80 (see FIGS. 4, 5, and 6) linking the cleaning unit 60 to the steering mechanism 29 such that when the floor cleaning apparatus 10 is in an operative mode, the cleaning unit 60 reorients its position in synchronization with the path of travel of the floor cleaning apparatus 10. This component and functionality of the floor cleaning apparatus 10 is available both when the apparatus operates in an offset cleaning mode, and when the apparatus operates in a non-offset cleaning mode.

In another embodiment, when the floor cleaning apparatus 10 is in a navigational mode, the cleaning unit 60 reorients its position in synchronization with the path of travel of the floor cleaning apparatus 10.

Swing mechanism 80 can include e.g. a pivot wheel 81, and is connected, in the illustrated embodiment, to support plate 73 of the cleaning assembly 50, and by means of endless belt or cable 82 (e.g., a Bowden cable) is also connected to steering mechanism 29. In operation, as an operator of the floor cleaning apparatus 10 turns to the left or the right using the steering mechanism 29, the cleaning unit 60 swings and reorients in synchronization with the steering mechanism 29. As illustrated, the cleaning unit 60 pivots about the axis of the pivot wheel 81. In other embodiments, the cleaning unit 60 may be configured to pivot about multiple pivot points, such as about multiple pivot wheels 81 that are rotatably driven by multiple endless cables 82. This swing functionality provides operational efficiency compared with a system in which the cleaning unit does not respond to and synchronize a change in its orientation with a change in the path of travel of the floor cleaning apparatus. In embodiments that include the deposition of a cleaning fluid onto the floor, and a squeegee/vacuum system 85 for picking up spent cleaning fluid, the wetted cleaning path on the floor should be completely or nearly covered by the cleaning unit, i.e. the spent cleaning fluid should be captured by the squeegee/vacuum system 85 and sucked up from the floor, even when the floor cleaning apparatus is making a sharp turn. Conventionally, this function requires a long squeegee/vacuum system 85 (suction foot) to be sure to pick up all the spent cleaning fluid, but such an arrangement is at odds with the need to drive through narrow floor areas. The swing mechanism of the invention enables the use of a relatively short squeegee/vacuum system 85 while still providing effective suction of spent cleaning fluid even during sharp turns of the apparatus.

In one embodiment, swing mechanism 80 includes the capability of incorporating a transition ratio between the degree of turn of the steering wheel, and the degree of turn of the cleaning unit.

In one embodiment, swing mechanism 80 is not linked directly to the steering axle of the steering mechanism.

Figure 6:
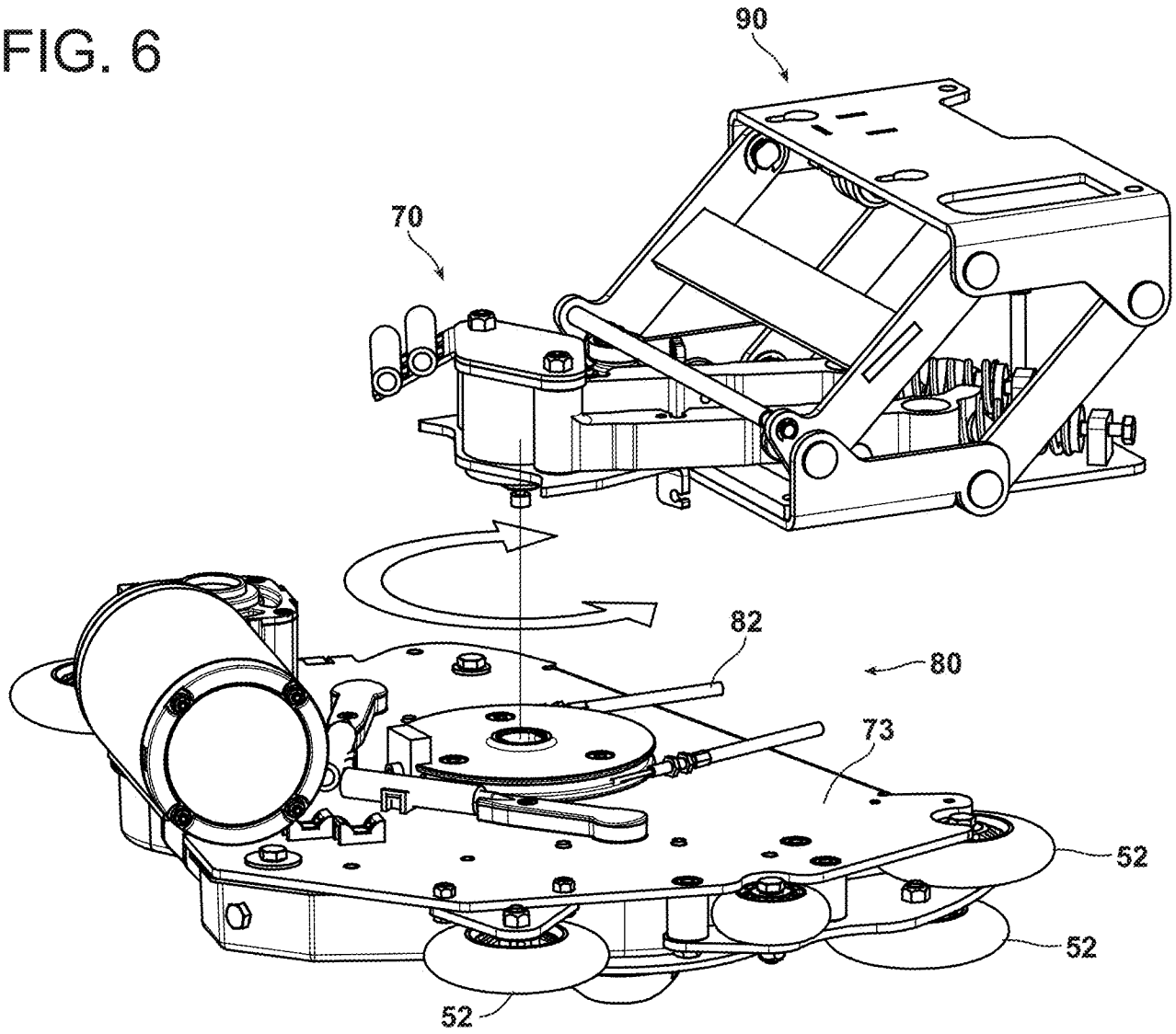
FIG. 6 is a perspective exploded view of a lifting device and cleaning assembly.

In one embodiment, the swing mechanism 80 includes a pivot wheel 81 positioned above the cleaning unit 60, as shown in FIG. 6. In another embodiment, the swing mechanism 80 includes a pivot wheel 81 positioned between the cleaning unit 60 and the offset mechanism 70.

Figure 3:
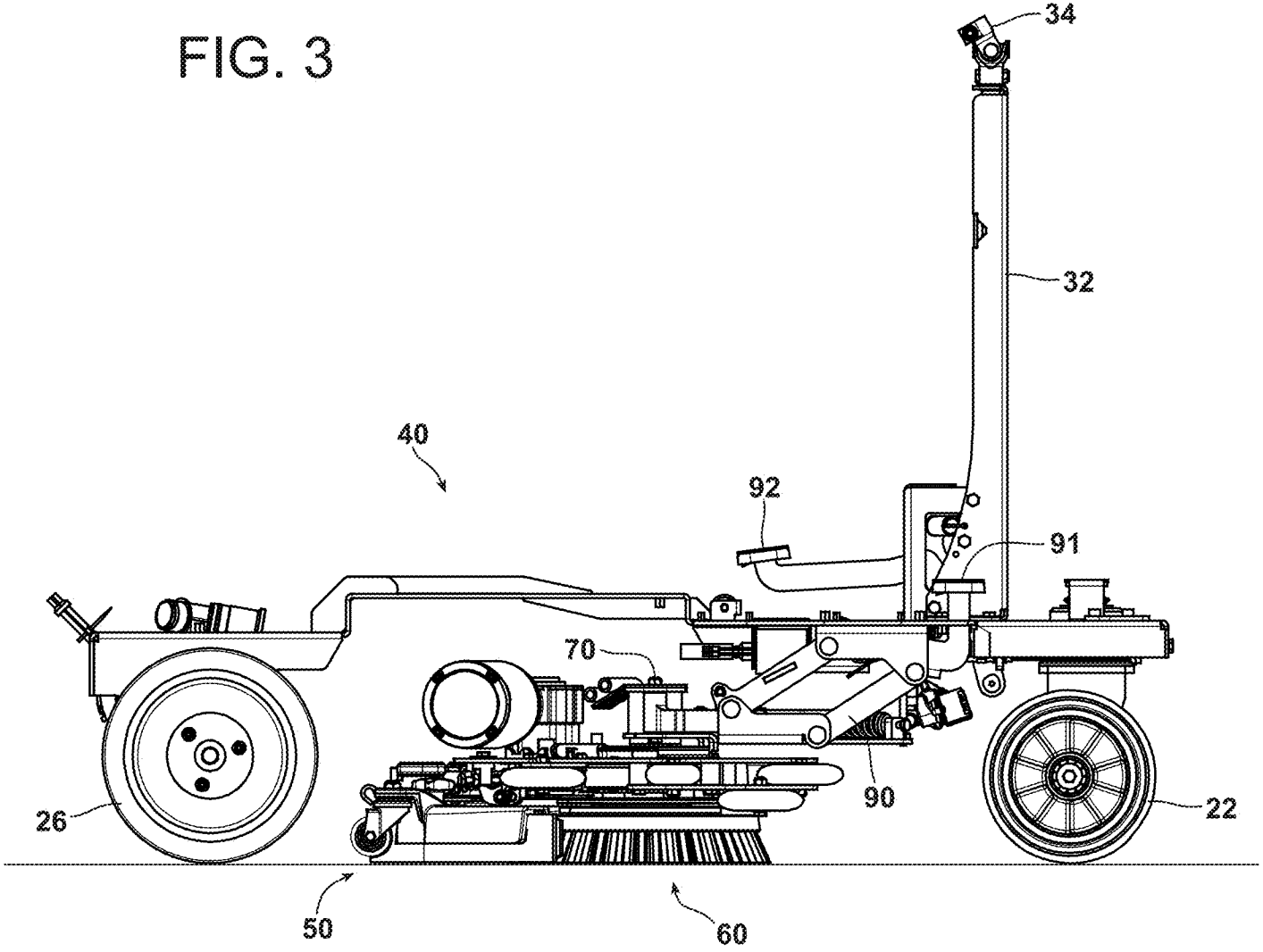
FIG. 3 is a side elevational view of a portion of a floor cleaning apparatus.

Apparatus 10 includes in one embodiment a lifting device 90 adapted to selectively raise and lower the cleaning assembly 50. As shown in FIGS. 3 and 5, in one embodiment lifting device 90 is affixed by an upper plate 93*a* to the chassis 40. The device 90 is in one embodiment a parallelogram-shaped framework that can be powered (by motive means not shown, such as e.g. an electric motor, or mechanically) to raise and lower the cleaning assembly 50. Spaced-apart connecting bars 95*a*/95*b*, and 96*a*/96*b* pivotably connect upper plate 93*a* to lower plate 93*b*. It can be seen that as the connecting bars and/or lower plate 93*b* are activated to raise lower plate 93*b*, in a direction away from the floor, the cleaning assembly is also raised from the floor. Because of the parallelogram configuration of lifting device 90, the relatively level planar position of cleaning assembly 50, and in particular cleaning unit 60, remains essentially the same during raising or lowering by lifting device 90.

Apparatus 10 includes in one embodiment an operator seat 28, situated between the forward component and the rearward component, and adapted to accommodate a human operator.

Apparatus 10 includes in one embodiment a chassis 40 (see FIG. 2) that provides a supporting frame for the housing and other components of the apparatus.

Apparatus 10 includes in one embodiment a support plate 73 (see FIG. 6) that serves to support the offset mechanism 70 and swing mechanism 80, and also supports the underlying cleaning unit 60.

Figure 7:
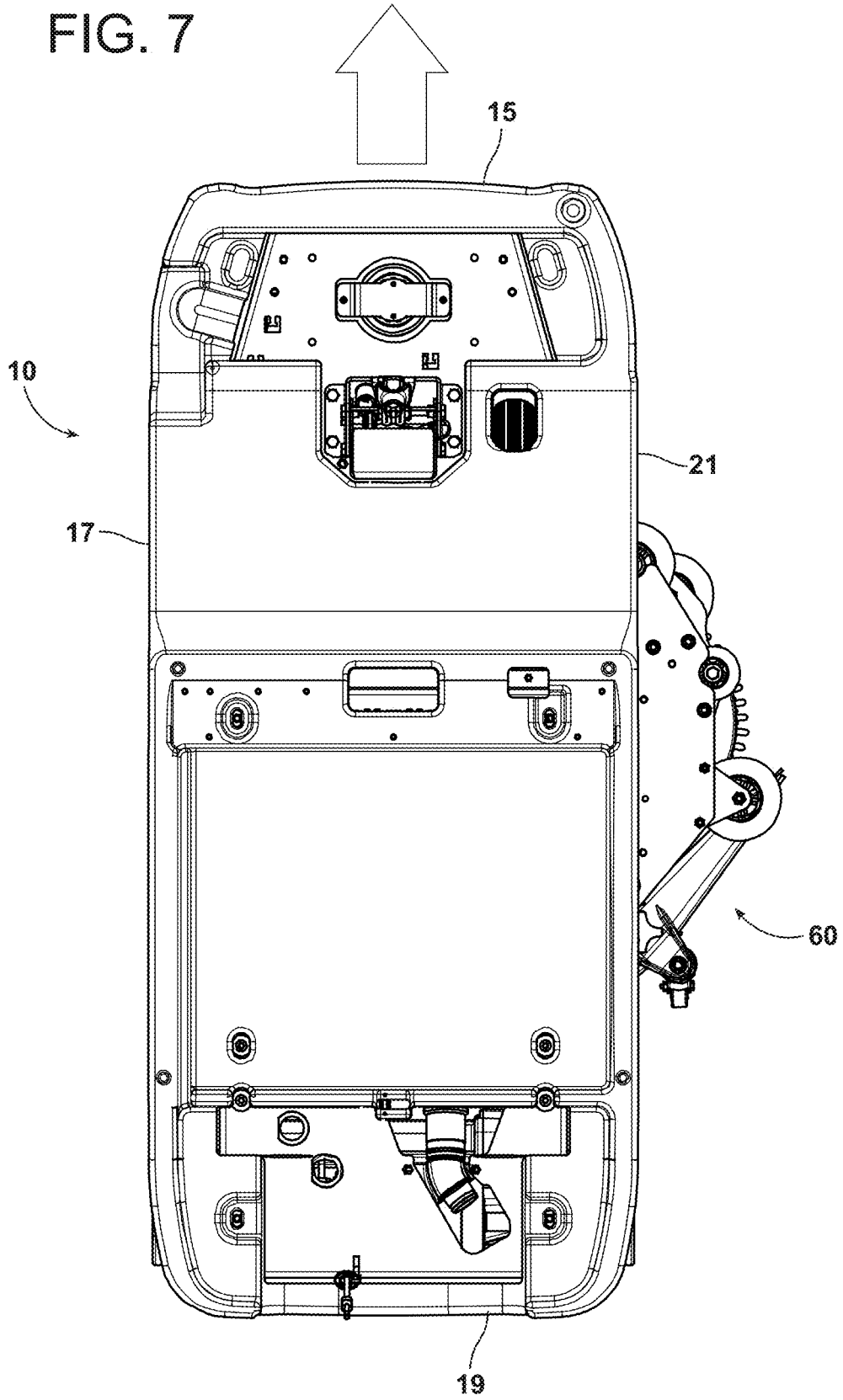
FIG. 7 is a top plan view of a relevant portion of a floor cleaning apparatus, with the cleaning unit in an offset cleaning mode, and the apparatus moving in a forward direction.
Figure 8:
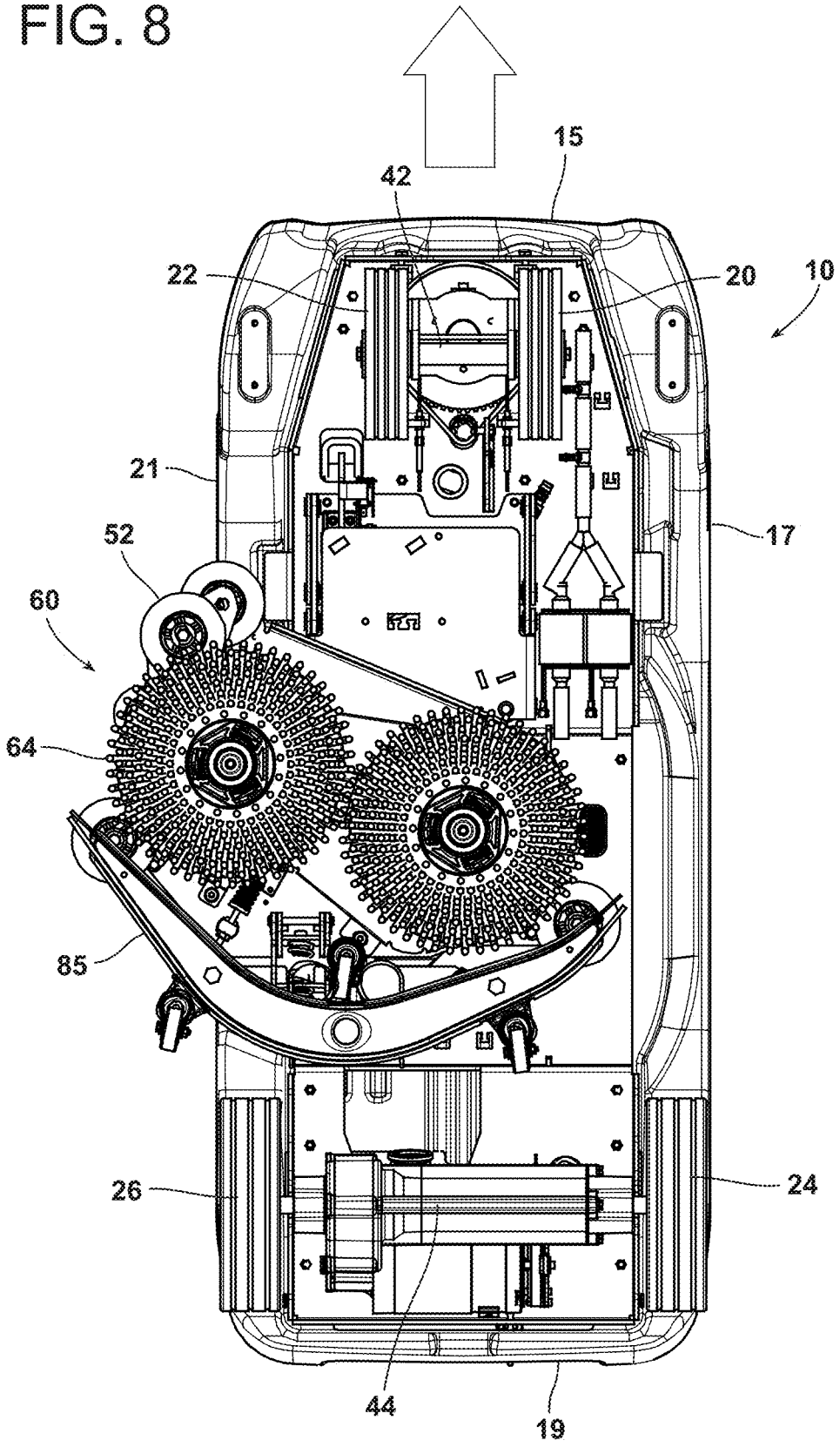
FIG. 8 is a bottom plan view of the floor cleaning apparatus of FIG. 7.

FIGS. 7 and 8 show a top and bottom plan view respectively of a floor cleaning apparatus 10, with the cleaning unit 60 in an offset cleaning mode, and the apparatus 10 moving in a forward direction. It can be seen that a portion of the cleaning unit 60, including a portion of cleaning brush 64, extends beyond the footprint of the floor cleaning apparatus 10. In the offset cleaning mode as shown, the apparatus 10 is configured to clean edge or floor areas to the lateral right side 21 of the apparatus, e.g. floor areas adjacent a wall that would be difficult or impossible to clean otherwise with the same apparatus in a non-offset position.

Figure 9:
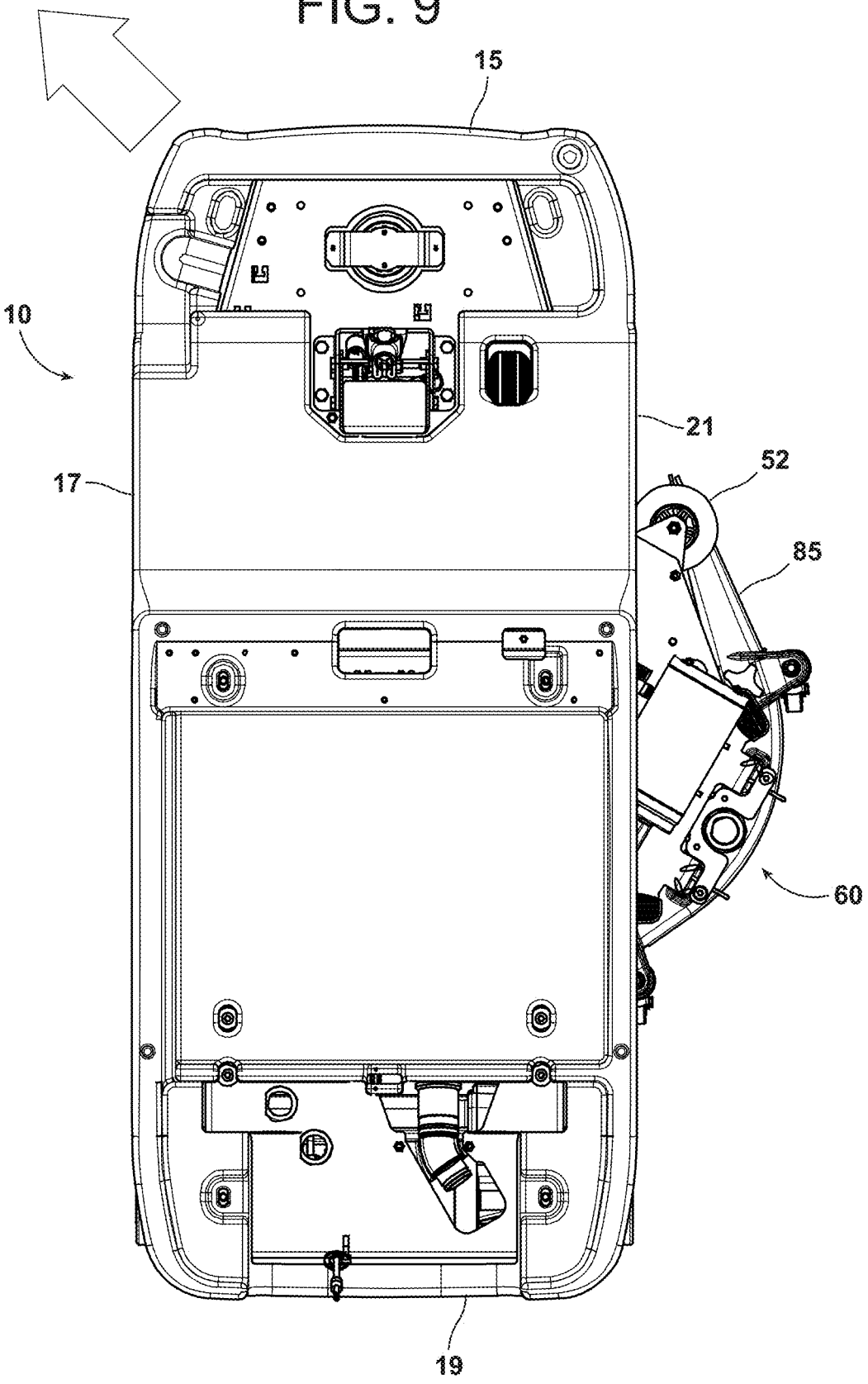
FIG. 9 is a top plan view of a relevant portion of a floor cleaning apparatus, with the cleaning unit in an offset cleaning mode, and the apparatus turning to the left.
Figure 10:
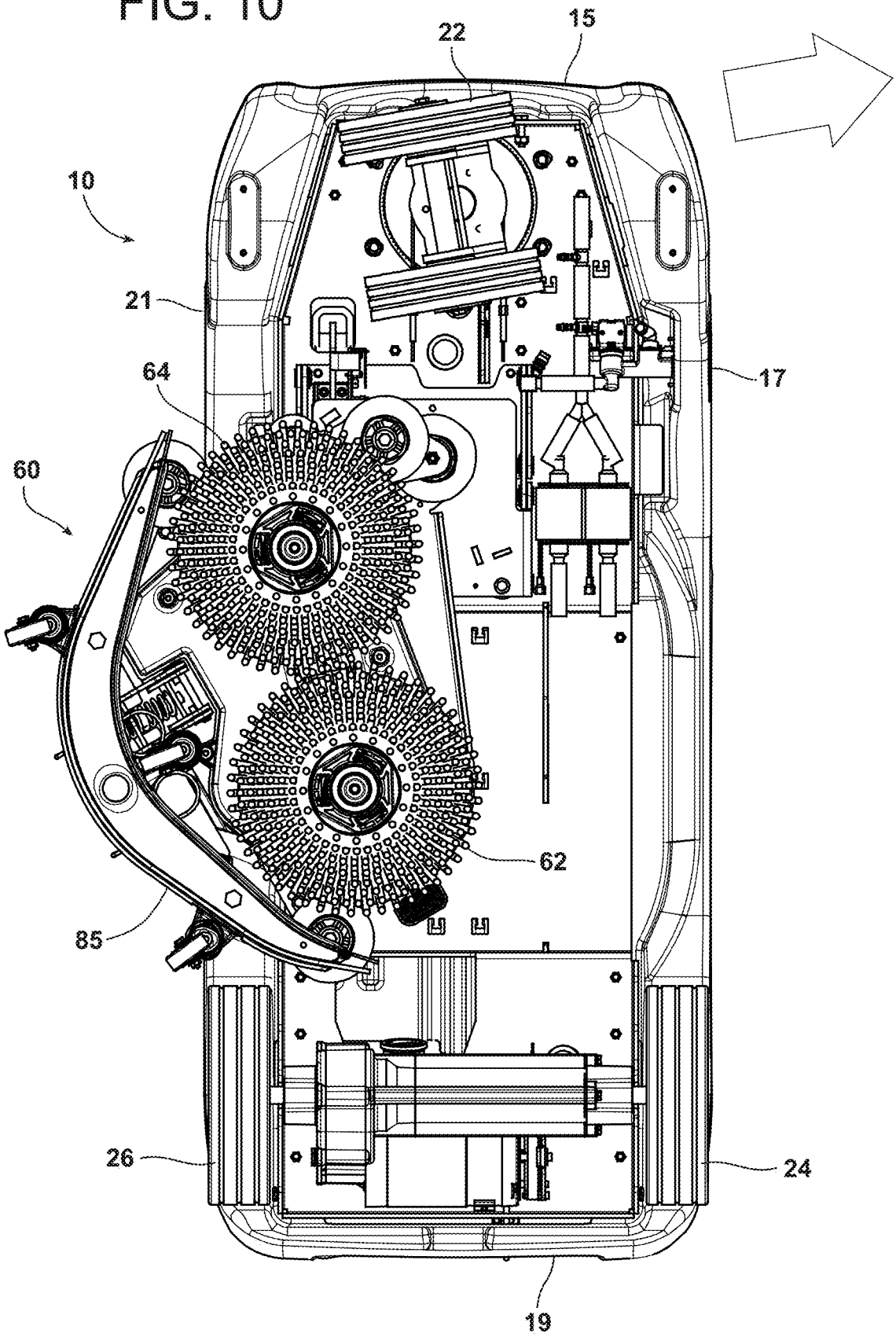
FIG. 10 is a bottom plan view of the floor cleaning apparatus of FIG. 9.

FIGS. 9 and 10 show a top and bottom plan view respectively of a relevant portion of a floor cleaning apparatus 10, with the cleaning unit 60 in an offset cleaning mode, and the apparatus 10 turning to the left. As with the apparatus as shown in FIGS. 7 and 8, the apparatus 10 is configured to clean edge or other floor areas to the lateral right side 21 of the apparatus 10.

Figure 11:
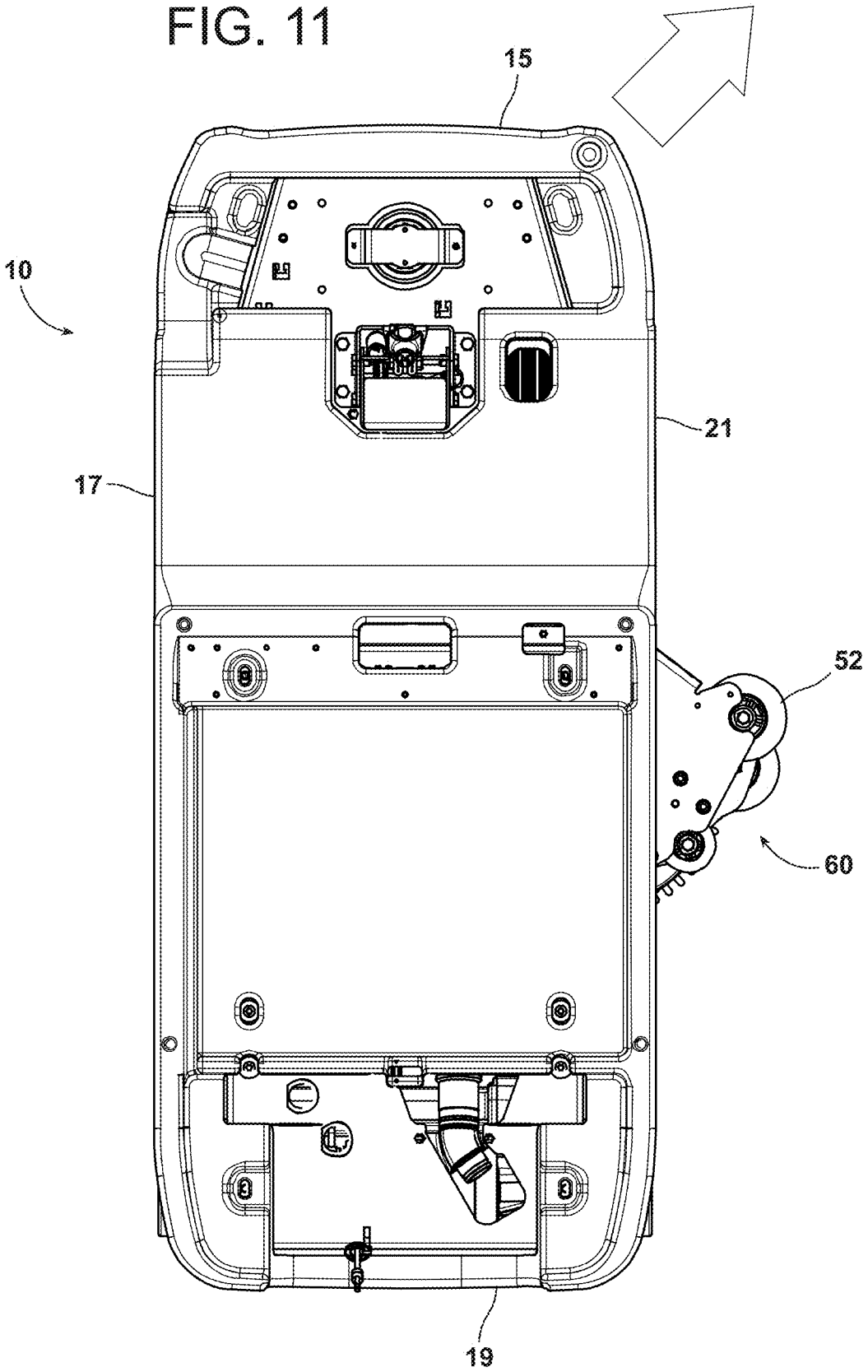
FIG. 11 is a top plan view of a relevant portion of a floor cleaning apparatus, with the cleaning unit in an offset cleaning mode, and the apparatus turning to the right.
Figure 12:
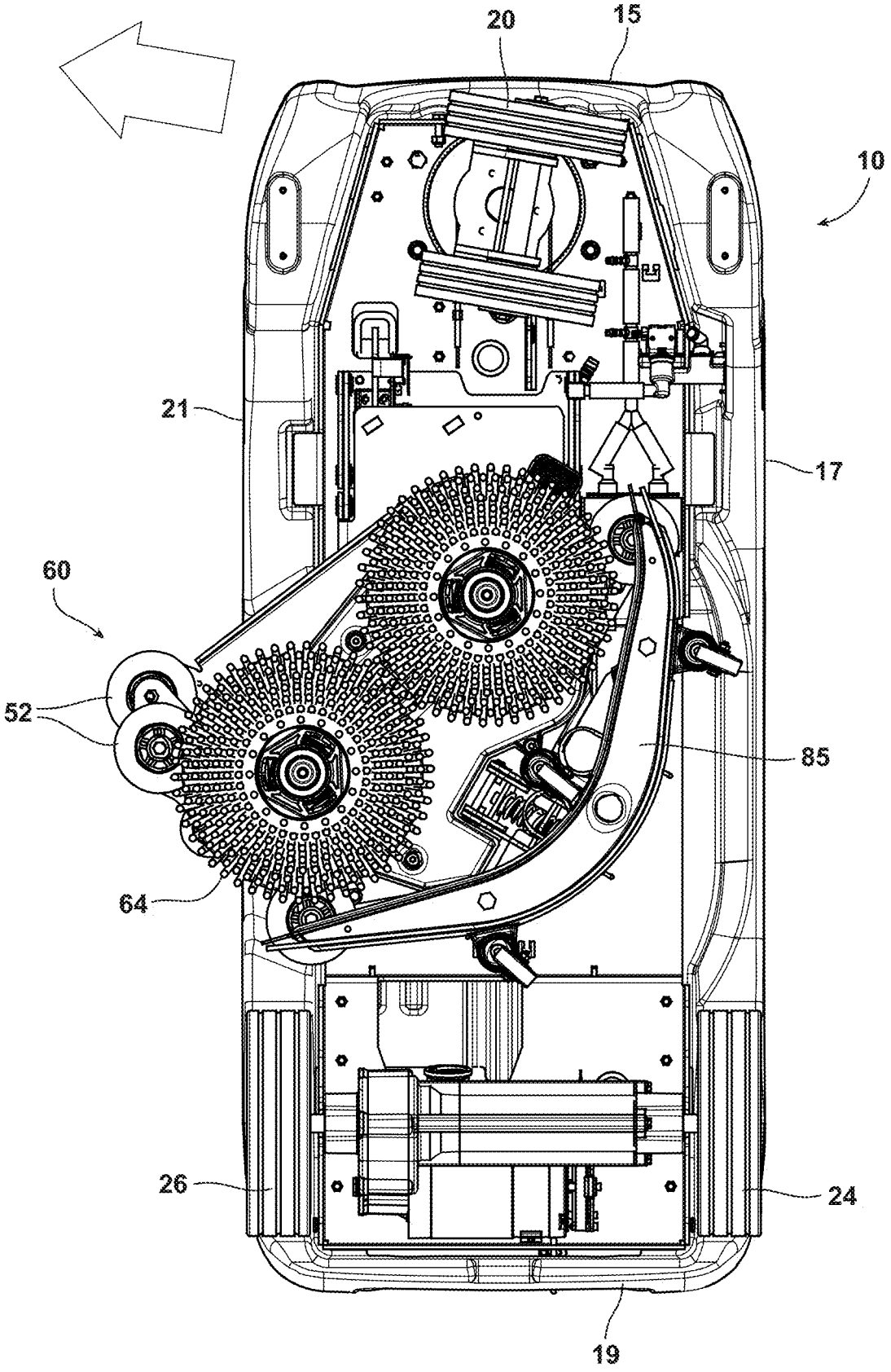
FIG. 12 is a bottom plan view of the floor cleaning apparatus of FIG. 11.

FIGS. 11 and 12 show a top and bottom plan view respectively of a relevant portion of a floor cleaning apparatus 10, with the cleaning unit 60 in an offset cleaning mode, and the apparatus 10 turning to the right. As with the apparatus as shown in FIGS. 7 and 8, the apparatus 10 is configured to clean edge or other floor areas to the lateral right side 21 of the apparatus 10.

Figure 13:
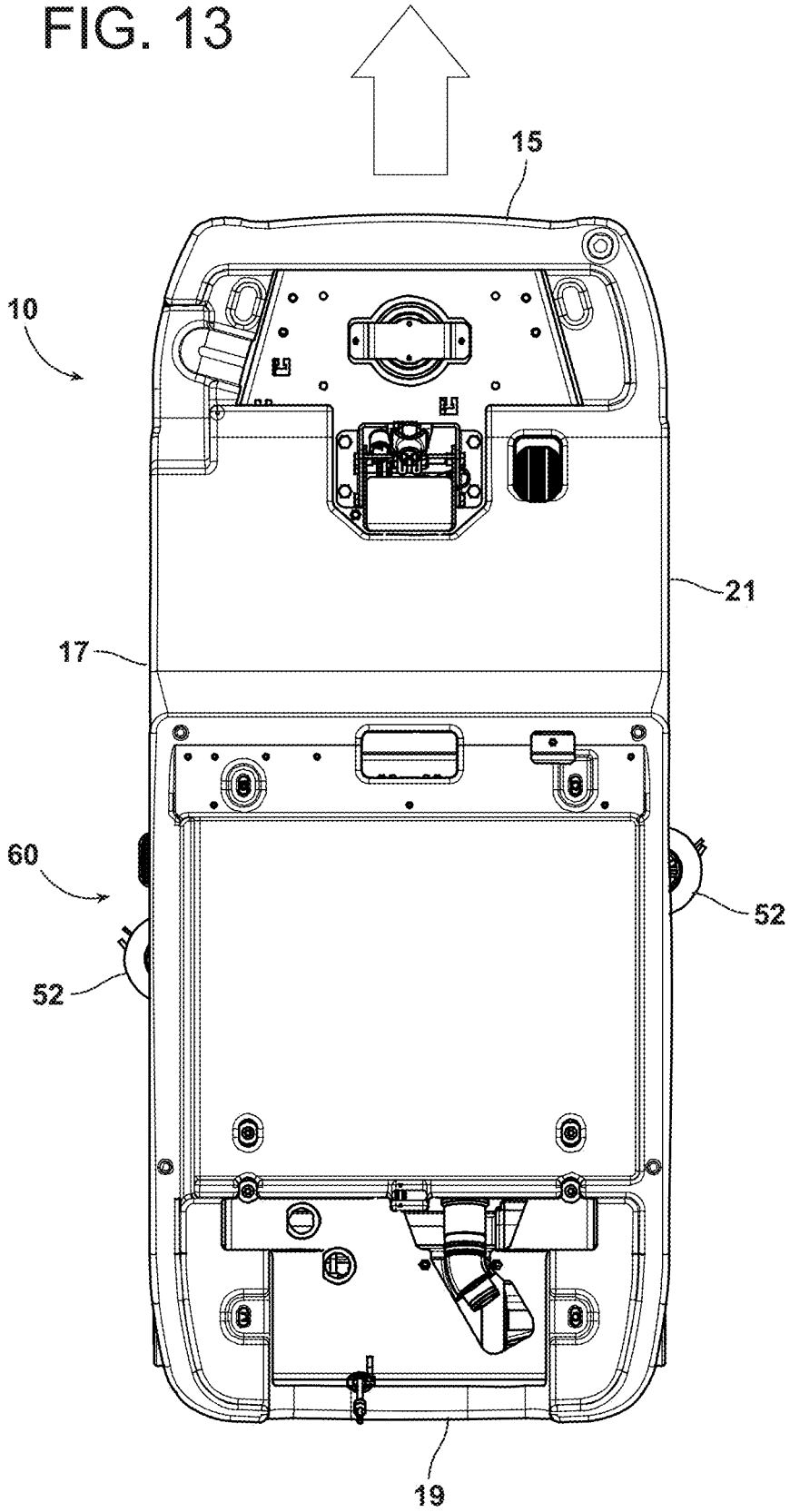
FIG. 13 is a top plan view of a relevant portion of a floor cleaning apparatus, with the cleaning unit in a non-offset cleaning mode, and the apparatus moving in a forward direction.
Figure 14:
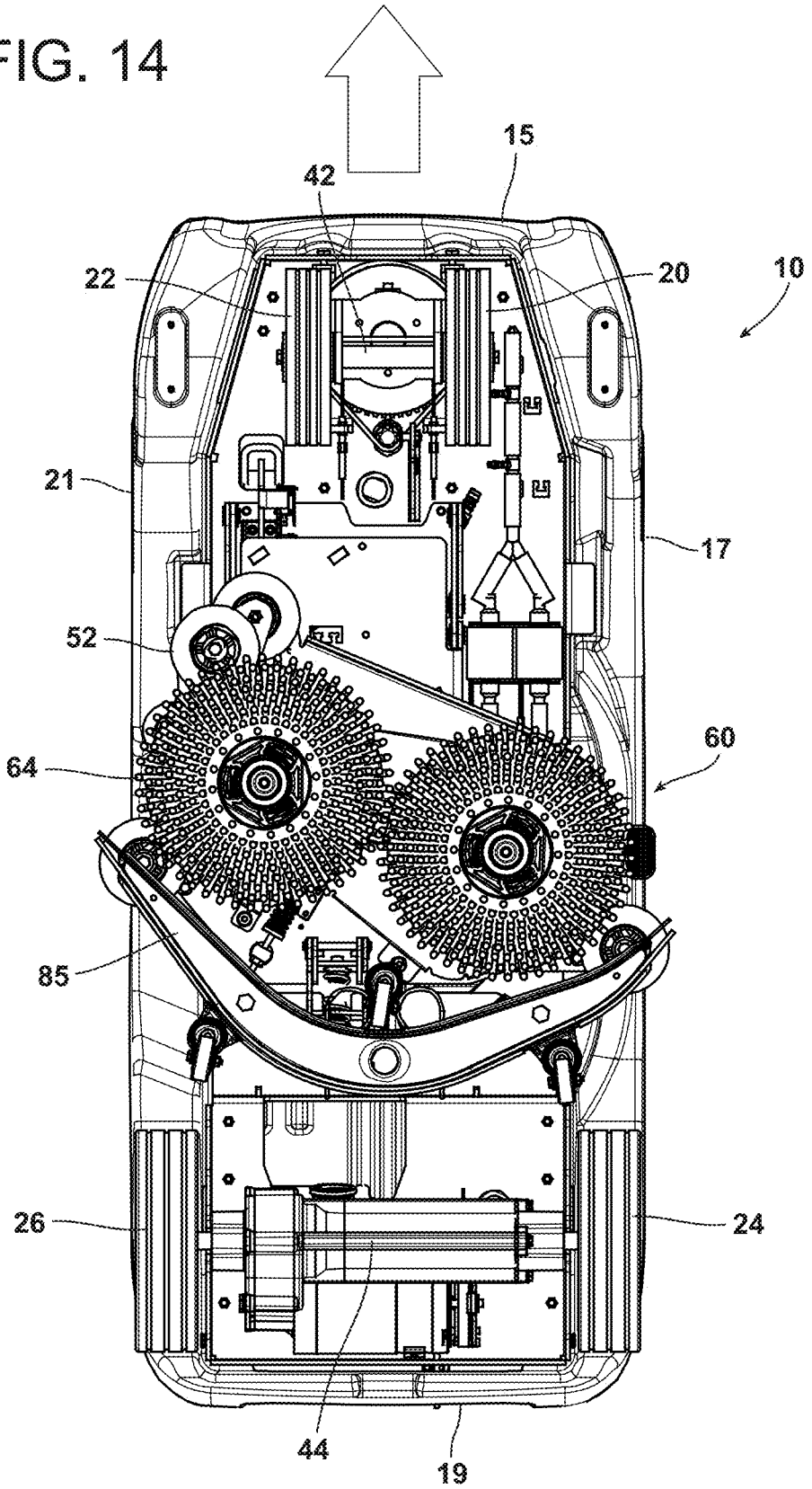
FIG. 14 is a bottom plan view of the floor cleaning apparatus of FIG. 13.

FIGS. 13 and 14 show a top and bottom plan view respectively of a floor cleaning apparatus 10, with the cleaning unit 60 in a non-offset cleaning mode, and the apparatus 10 moving in a forward direction. It can be seen that substantially all of the cleaning unit 60, except for a portion of edge wheels 52, is positioned within and underneath the overall footprint of the floor cleaning apparatus 10. In the non-offset cleaning mode as shown, the apparatus 10 is configured to clean a floor where it is not critical to reach floor areas beyond the footprint of the apparatus 10, and/or when navigating relatively narrow floor areas, passage ways, and the like, where the lateral extent of the apparatus, including the cleaning unit 60, is desirably kept to a minimum.

Figure 15:
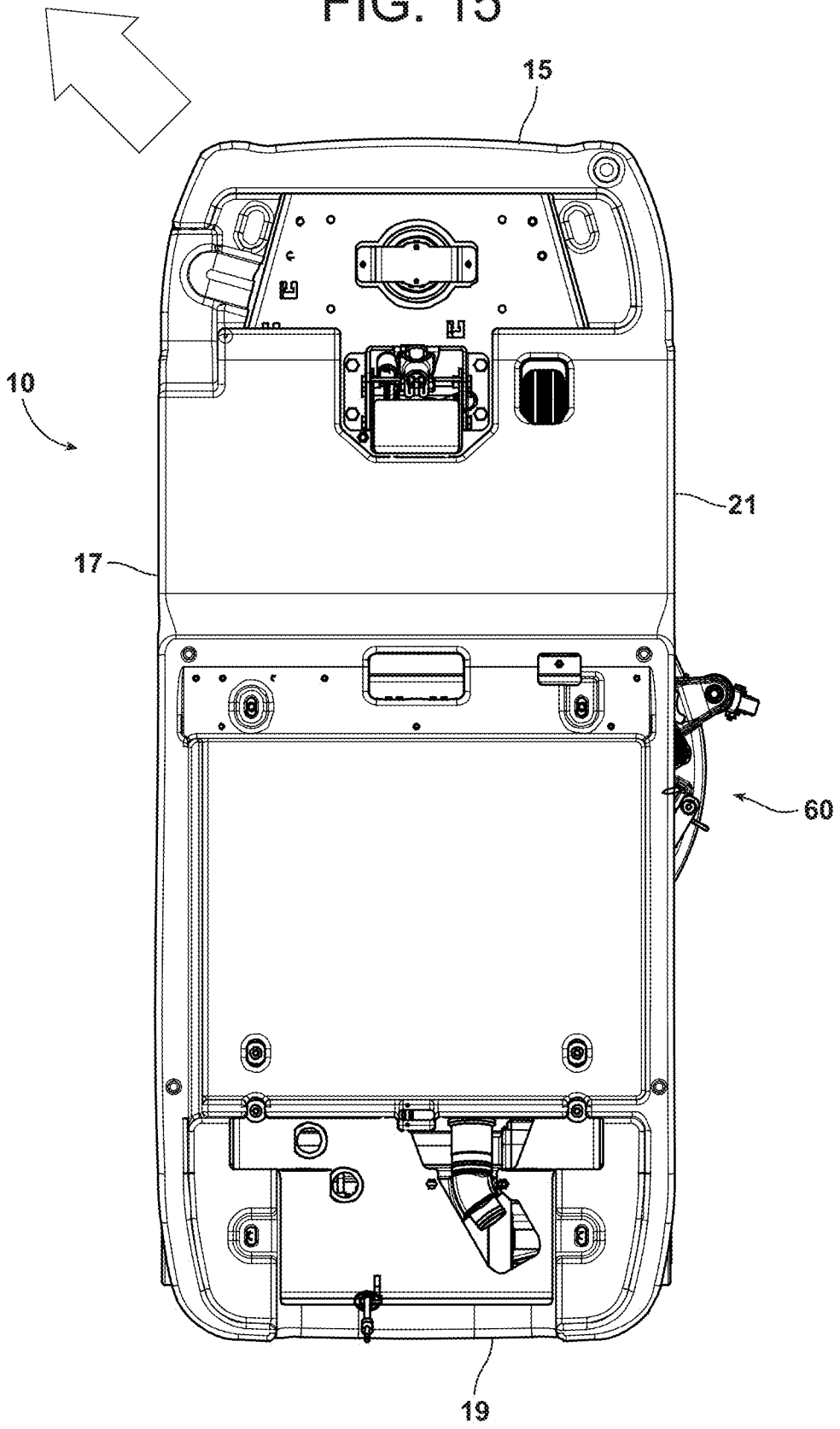
FIG. 15 is a top plan view of a relevant portion of a floor cleaning apparatus, with the cleaning unit in a non-offset cleaning mode, and the apparatus turning to the left.
Figure 16:
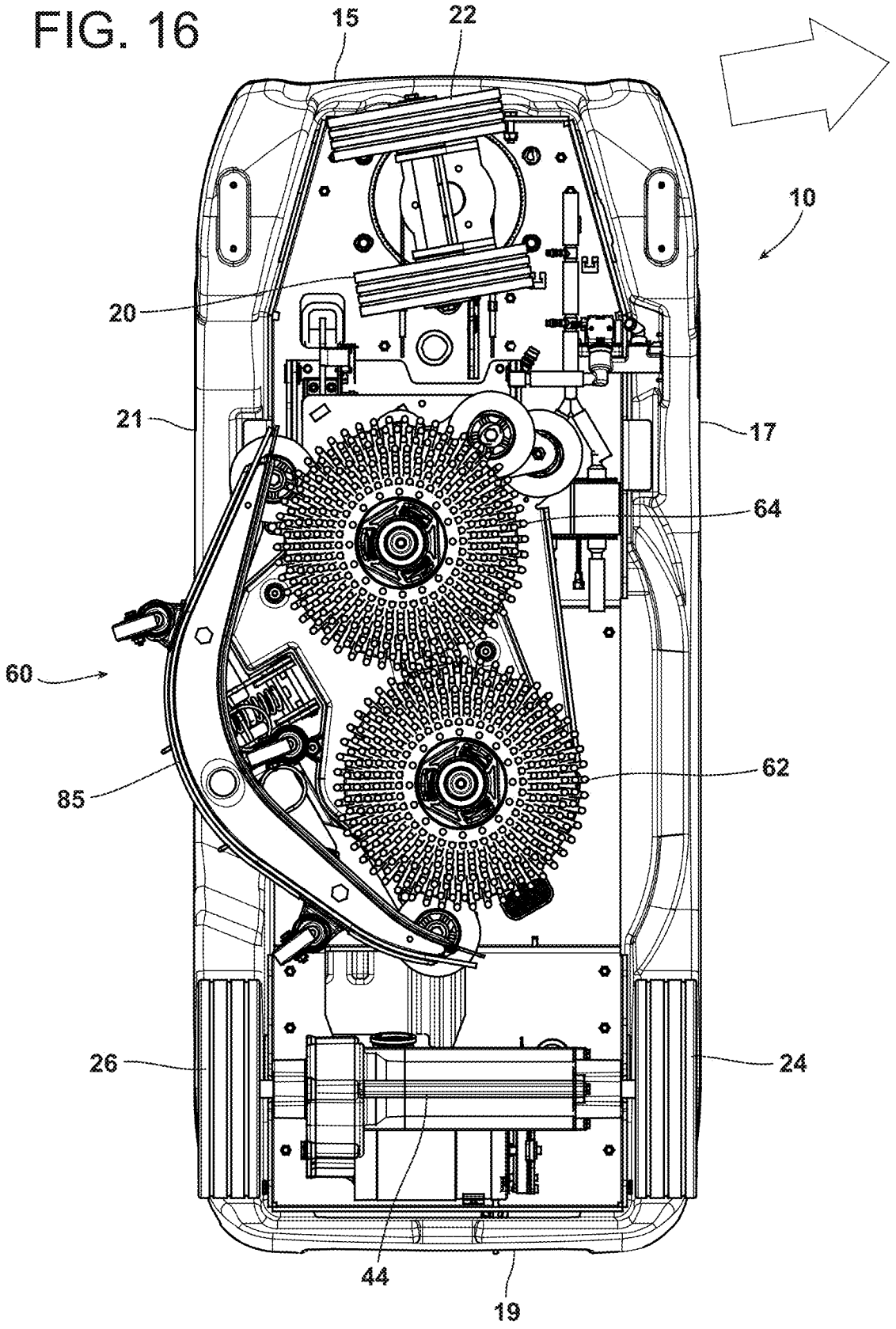
FIG. 16 is a bottom plan view of the floor cleaning apparatus of FIG. 15.

FIGS. 15 and 16 show a top and bottom plan view respectively of a relevant portion of a floor cleaning apparatus 10, with the cleaning unit 60 in a non-offset cleaning mode, and the apparatus 10 turning to the left. As with the apparatus as shown in FIGS. 13 and 14, the apparatus 10 is configured to clean a floor where it is not critical to reach floor areas beyond the footprint of the apparatus, and/or when navigating relatively narrow floor areas, passage ways, and the like, where the lateral extent of the apparatus, including the cleaning unit 60, is desirably kept to a minimum.

Figure 17:
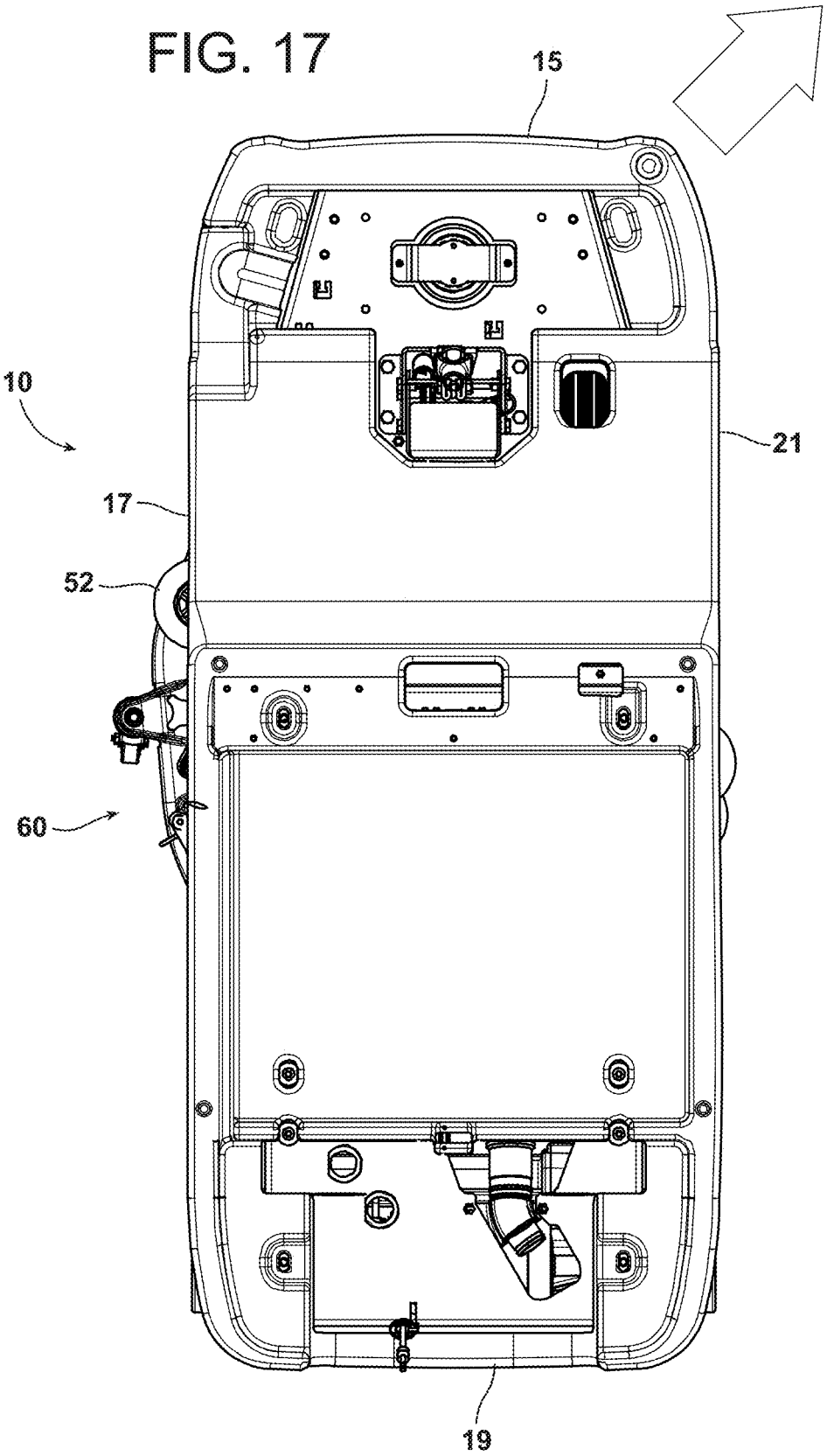
FIG. 17 is a top plan view of a relevant portion of a floor cleaning apparatus, with the cleaning unit in a non-offset cleaning mode, and the apparatus turning to the right.
Figure 18:
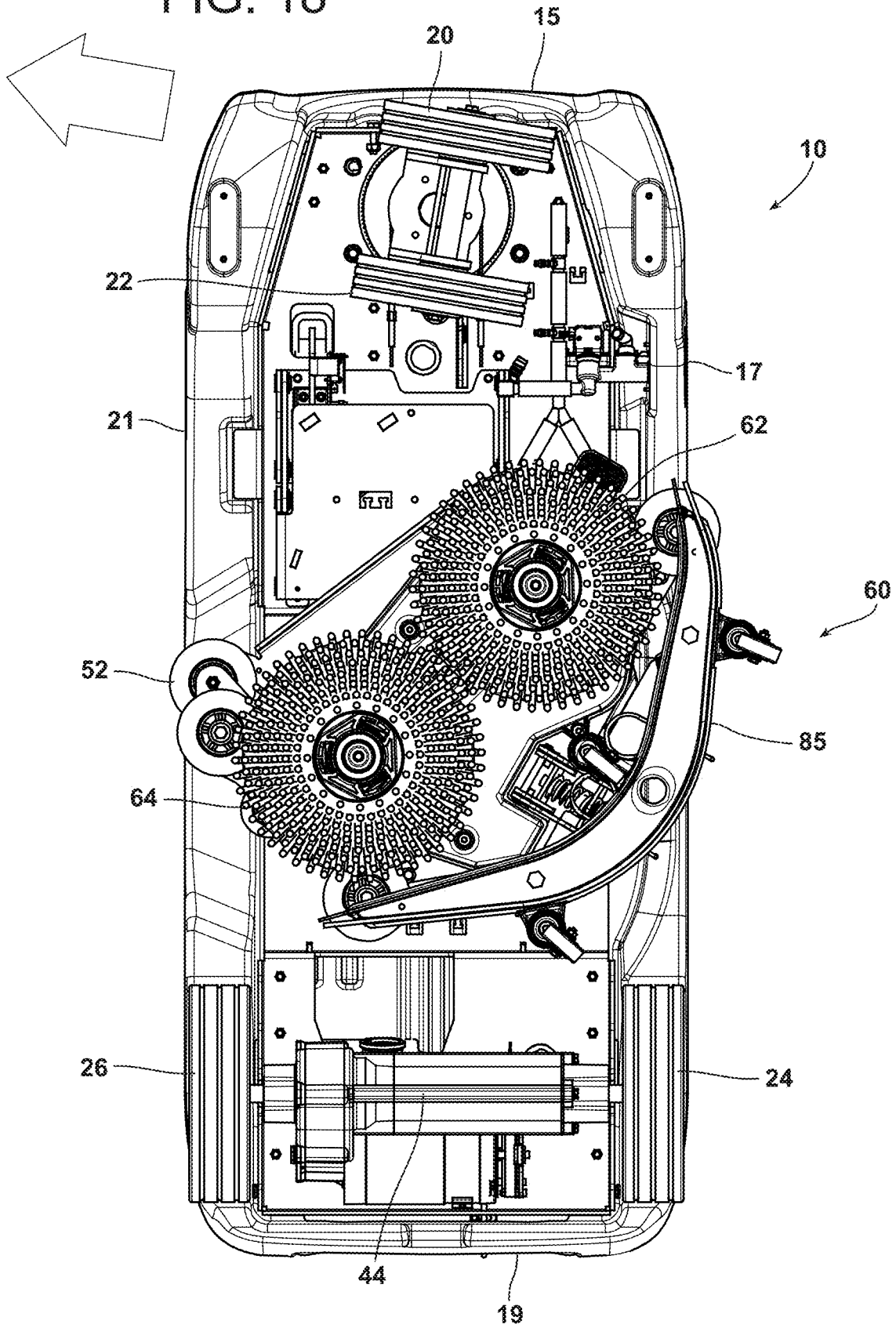
FIG. 18 is a bottom plan view of the floor cleaning apparatus of FIG. 17.

FIGS. 17 and 18 show a top and bottom plan view respectively of a relevant portion of a floor cleaning apparatus 10, with the cleaning unit 60 in a non-offset cleaning mode, similar to the embodiment of FIGS. 15 and 16, but with the apparatus 10 turning to the right.

In each of these cleaning modes and configurations, the cleaning unit 60 has in one embodiment a fixed working width that remains constant whether the apparatus is in an offset mode or non-offset mode.

Although in the embodiments illustrated herein, the cleaning unit 60 in the offset position extends beyond the lateral right side 21 of the floor cleaning apparatus 10, those of skill in the art will appreciate that in an alternative embodiment, the apparatus can be configured such that the cleaning unit in the offset position extends beyond the lateral left side 17 of the floor cleaning apparatus.

In an alternative embodiment, the cleaning unit 60 can have a variable working width in an offset mode and/or non-offset mode.

The floor cleaning apparatus 10 of the invention can in various embodiments utilize and incorporate various features typical of powered floor cleaning machines.

The housing 12 in one embodiment has a rearward component 18 that can include e.g. reservoirs for storing fresh 35 and spent 36 cleaning liquid (depicted, though not explicitly shown in FIG. 1). The housing 12 can also include any of a mechanism (not shown) for dosing and dispensing fresh cleaning liquid onto the floor, and a squeegee/vacuum system 85 for recovering spent cleaning liquid from the floor. In one embodiment, the mechanism for dosing and dispensing can be located in the lower portion of housing 12, near the floor. In one embodiment, a squeegee/vacuum system 85 is located rearward of the mechanism for dosing and dispensing a cleaning fluid, and rearward of any cleaning brushes 62, 64 if present. The housing 12 in one embodiment has a forward component 14 that can be used to house functional elements such as the steering mechanism 29, and to serve as protection for the operator.

The cleaning unit 60 can comprise any device or assembly that affects or treats the floor surface. This can include a mechanism for the cleaning of carpets or hard surfaces of large floor areas, such as in hotels, factories, office buildings, shopping centers and the like. The cleaning unit 60 can include any of a movable body carrying at least one brush; a scrubber, sweeper, or the like. In one embodiment, the cleaning unit 60 includes any of a scrubbing device such as a motor-driven circular or cylindrical scrubbing brush or brushes; reservoirs 35, 36 for storing fresh and spent cleaning liquid; a device for dosing and dispensing a fresh cleaning liquid onto the floor, and a squeegee/vacuum system 85 for recovering spent cleaning liquid from the floor. The cleaning unit 60 in one embodiment comprises one or more cleaning implements, such as brushes or scrubbing pads and a motor for driving the implements.

In one embodiment, the operator seat is adjustable to enable the operator to adjust the height of the seat to accommodate the height of the operator.

In another embodiment, the steering mechanism is adjustable to optimize its location for the benefit and comfort of the operator.

In one embodiment, the present invention can be utilized in conjunction with the invention disclosed in U.S. provisional patent application Ser. No. 62/058,733 (Scheiwiller), entitled "Ergonomic Floor Cleaning Apparatus", filed on Oct. 2, 2014; that application incorporated in its entirety herein by reference. Thus, the present floor cleaning apparatus 10 can be configured such that when the apparatus is in an operative or navigational mode, the human operator is situated on the seat such that the operator is in a partially seated and partially standing position.

STATEMENT OF EMBODIMENTS OF THE INVENTION

The present application is directed in various embodiments to the subject matter described in the following paragraphs. These are optional embodiments of any of the apparatus and method aspects of the invention as described hereinabove. For each aspect, these features can be incorporated alone or in any suitable combination of these features:

- The cleaning unit has a fixed working width.
- The housing comprises a forward component, an intermediate component, and a rearward component.
- The floor cleaning apparatus comprises an operator seat.
- The floor cleaning apparatus comprises a chassis.
- The cleaning unit comprises a brush assembly.
- The floor cleaning apparatus comprises a lifting device adapted to selectively raise and lower the cleaning assembly.
- The cleaning assembly comprises a support plate that supports any of the offset mechanism, the swing mechanism, and the cleaning unit.
- The floor cleaning apparatus comprises any of a motor-driven scrubbing brush, a scrubbing pad, a polisher, a vacuum system, a spray extractor, a reservoir for storing fresh cleaning liquid, a reservoir for storing spent cleaning liquid, a device for dispensing fresh cleaning liquid onto the floor, and a squeegee/vacuum system for recovering spent cleaning liquid from the floor.
- The plurality of wheels comprises two front wheels connected with a front axle, and two rear wheels connected with a rear axle, wherein the two front wheels are spaced apart a distance less than the distance between the two rear wheels.
- The cleaning assembly comprises a biasing member.
- The floor cleaning apparatus is configured such that when the apparatus is in a navigational mode, the human operator is situated on the seat such that the operator is in a partially seated and partially standing position.
- When the floor cleaning apparatus is in a navigational mode, the back of the human operator is substantially vertical.
- When the floor cleaning apparatus is in a navigational mode, the upper legs of the human operator are sloped downward toward the front end of the floor cleaning apparatus.
- When the floor cleaning apparatus is in a navigational mode, the lower legs of the human operator are substantially vertical, or slightly inclined toward the front end of the floor cleaning apparatus.
- When the floor cleaning apparatus is in a navigational mode, the human operator is situated at substantially the same height as if the human operator were standing adjacent the floor cleaning apparatus.
- When the floor cleaning apparatus is in a navigational mode, the overall position of the human operator is substantially equidistant between the front end and the back end of the apparatus.
- When the floor cleaning apparatus is in a navigational mode, the human operator is situated close to or at the longitudinal center of the floor cleaning apparatus.
- The cleaning unit comprises a device for polishing the floor.
- The cleaning unit comprises a device for vacuuming the floor.

Embodiments above have been described in an illustrative manner, and the terminology used is intended to be descriptive rather than limiting. Modifications and variations of the illustrated embodiments are possible in light of the above teachings. Therefore, within the scope of the appended claims, wherein reference numerals are provided merely for convenience and are not to be in any way limiting, the invention may be practiced other than as specifically described in the illustrative embodiments.

What is claimed is:

1. A floor cleaning apparatus for cleaning a floor, the apparatus adapted to traverse a path of travel, comprising:

a housing;

a plurality of wheels by which the floor cleaning apparatus is adapted to move across the floor in a direction of travel, the direction of travel at least partially defining a front end, a back end, and first and second lateral sides of the floor cleaning apparatus;

a motive device for moving the apparatus across the floor;

a steering mechanism operationally coupled to at least one of the plurality of wheels to guide the path of the floor cleaning apparatus; wherein the steering mechanism may comprise at least one of a steering wheel, hand gears, hand levers, steering linkage, a user interface, a dash board, and a steering axle; and a cleaning assembly comprising;

a cleaning unit that cleans the floor when the floor cleaning apparatus is in an operative mode, wherein the cleaning unit comprises at least one of a brush assembly, dispenser, burnishing device, polishing device, sweeping device, vacuum device, scrubbing pads and/or combinations thereof;

a swing mechanism linking the cleaning unit to the steering mechanism such that when the floor cleaning apparatus is in the operative mode, the cleaning unit reorients its position in synchronization with the path of travel of the floor cleaning apparatus; wherein the swing mechanism links the cleaning unit and steering mechanism via at least one of a pivot wheel, support plate, endless belt, endless cable, or Bowden Belt; and an offset mechanism separate from the swing mechanism, the offset mechanism adapted to move the cleaning unit between a non-offset position and an offset position, the cleaning unit being selectively placed in the operative mode in either of the non-offset and offset positions; wherein the offset mechanism comprises mechanical actuation or electrical actuation; wherein the mechanical actuation comprises a manual shifting device, linkage to a foot pedal, linkage to a hand operated lever, button activation, switch activation, or a touch panel; and wherein the electrical actuation comprises an input device to actuate a DC motor or AC motor.

2. The floor cleaning apparatus of claim 1 comprising a lifting device adapted to selectively raise and lower the cleaning assembly; wherein the lifting device comprises a framework powered to raise and lower the cleaning assembly.

3. The floor cleaning apparatus of claim 1 wherein the cleaning unit comprises any of:

a motor-driven scrubbing brush;

a scrubbing pad;

a polisher;

a vacuum system;

a spray extractor;

a reservoir for storing fresh cleaning liquid;

a reservoir for storing spent cleaning liquid;

a device for dispensing fresh cleaning liquid onto the floor; and a squeegee/vacuum system for recovering spent cleaning liquid from the floor.

4. The floor cleaning apparatus of claim 1, wherein the cleaning the cleaning unit has a fixed working width defined by a working width of a cleaning implement of the cleaning unit that effects cleaning of the floor; and wherein the cleaning implement comprises brushes or a scrubbing pad driven by a motor.

5. The floor cleaning apparatus of claim 4 wherein the cleaning implement comprises a plurality of motor-driven scrubbing brushes adapted to clean the floor in the operative mode in either of the non-offset and offset positions.

6. The floor cleaning apparatus of claim 4 wherein the cleaning implement comprises a squeegee/vacuum system for recovering spent cleaning liquid from the floor in the operative mode in either of the non-offset and offset positions.

7. The floor cleaning apparatus of claim 1 wherein the swing mechanism links the cleaning unit to the steering mechanism at a pivot wheel that is spaced from the steering mechanism, the rotation of the pivot wheel in response to steering changes defining a pivot axis about which the cleaning unit pivots, and particularly wherein the pivot wheel and pivot axis move with the cleaning unit between the non-offset position and the offset position.

8. The floor cleaning apparatus of claim 7 wherein the pivot wheel and steering mechanism define a transition ratio between a degree of turn of the steering mechanism and a degree of turn of the cleaning unit.

9. The floor cleaning apparatus of claim 1 wherein when the steering mechanism guides the path of the cleaning apparatus towards a first lateral side of the cleaning apparatus, the cleaning unit pivots in synchronization with the steering mechanism towards a second opposite lateral side of the cleaning apparatus.

10. The floor cleaning apparatus of claim 1 wherein the cleaning unit includes one or more biasing members configured to facilitate movement of the offset mechanism and thus of the cleaning unit to and from an offset position, and wherein when the cleaning unit is in the offset position, the biasing members bias the cleaning unit towards the offset position, but permit the cleaning unit to move toward the non-offset position, toward an underside of the apparatus whenever said cleaning unit is operating in an offset position and bumps into an obstacle, and wherein after engagement with the obstacle has discontinued, the cleaning unit returns to the offset position with the assistance of the biasing members; and wherein the biasing members comprise one or more springs that facilitate movement of the offset mechanism.

11. The floor cleaning apparatus of claim 1 wherein in the offset position, the cleaning unit projects beyond only one lateral side of the floor cleaning apparatus.

12. A floor cleaning apparatus for cleaning a floor, the apparatus adapted to traverse a path of travel, comprising:

a housing;

a plurality of wheels by which the floor cleaning apparatus is adapted to move across the floor in a direction of travel, the direction of travel at least partially defining a front end, a back end, and first and second lateral sides of the floor cleaning apparatus;

a motive device for moving the apparatus across the floor;

a steering mechanism; wherein the steering mechanism may comprise at least one of a steering wheel, hand gears, hand levers, steering linkage, a user interface, a dash board, and a steering axle; and a cleaning assembly comprising:

a cleaning unit, wherein the cleaning unit comprises at least one of a brush assembly, dispenser, burnishing device, polishing device, sweeping device, vacuum device, scrubbing pads, and/or combinations thereof;

a swing mechanism linking the cleaning unit to the steering mechanism and configured such that, when the floor cleaning apparatus is in an operative mode, the cleaning unit reorients its position in synchronization with the path of travel of the floor cleaning apparatus, wherein the swing mechanism links the cleaning unit and steering mechanism via at least one of a pivot wheel, support plate, endless belt, endless cable, or Bowden Belt; and an offset mechanism operable independent of the swing mechanism, the offset mechanism adapted to move the cleaning unit to or from an offset position, wherein the offset mechanism is configured to enable the cleaning unit to move from a non-offset position and cleaning mode to an offset position and cleaning mode, or from an offset position and cleaning mode to a non-offset position and cleaning mode, and wherein the floor cleaning apparatus is configured to operate selectively in either the offset cleaning mode or the non-offset cleaning mode, and wherein the offset mechanism comprises mechanical actuation or electrical actuation; wherein the mechanical actuation comprises a manual shifting device, linkage to a foot pedal, linkage to a hand operated lever, button activation, switch activation, or a touch panel; and wherein the electrical actuation comprises an input device to actuate a DC motor or AC motor.

13. The floor cleaning apparatus of claim 12 comprising a lifting device adapted to selectively raise and lower the cleaning assembly; wherein the lifting device comprises a framework powered to raise and lower the cleaning assembly.

14. The floor cleaning apparatus of claim 12 wherein the cleaning unit comprises any of:

a motor-driven scrubbing brush;

a scrubbing pad;

a polisher;

a vacuum system;

a spray extractor;

a reservoir for storing fresh cleaning liquid;

a reservoir for storing spent cleaning liquid;

a device for dispensing fresh cleaning liquid onto the floor; and a squeegee/vacuum system for recovering spent cleaning liquid from the floor.

15. The floor cleaning apparatus of claim 12, wherein the cleaning the cleaning unit has a fixed working width defined by a working width of a cleaning implement of the cleaning unit that effects cleaning of the floor, the working width remaining constant whether the apparatus is in the offset cleaning mode or the non-offset cleaning mode.

16. The floor cleaning apparatus of claim 15 wherein the cleaning implement comprises a plurality of motor-driven scrubbing brushes adapted to clean the floor in the operative mode in either of the offset cleaning mode or the non-offset cleaning mode; and wherein the cleaning implement comprises brushes or a scrubbing pad driven by a motor.

17. The floor cleaning apparatus of claim 15 wherein the cleaning implement comprises a squeegee/vacuum system for recovering spent cleaning liquid from the floor in the operative mode in either of the offset cleaning mode or the non-offset cleaning mode.

18. The floor cleaning apparatus of claim 12 wherein the swing mechanism links the cleaning unit to the steering mechanism at a pivot wheel that is spaced from the steering mechanism, the rotation of the pivot wheel in response to steering changes defining a pivot axis about which the cleaning unit pivots, and particularly wherein the pivot wheel and pivot axis move with the cleaning unit between the non-offset position and the offset position.

19. The floor cleaning apparatus of claim 18 wherein the pivot wheel and steering mechanism define a transition ratio between a degree of turn of the steering mechanism and a degree of turn of the cleaning unit.

20. The floor cleaning apparatus of claim 12 wherein when the steering mechanism guides the path of the cleaning apparatus towards a first lateral side of the cleaning apparatus, the cleaning unit pivots in synchronization with the steering mechanism towards a second opposite lateral side of the cleaning apparatus.

21. The floor cleaning apparatus of claim 12 wherein the cleaning unit includes one or more biasing members configured to facilitate movement of the offset mechanism and thus of the cleaning unit to and from an offset position, and wherein when the cleaning unit is in the offset position, the biasing members bias the cleaning unit towards the offset position, but permit the cleaning unit to move toward the non-offset position, toward an underside of the apparatus whenever said cleaning unit is operating in an offset position and bumps into an obstacle, and wherein after engagement with the obstacle has discontinued, the cleaning unit returns to the offset position with the assistance of the biasing members; and wherein the biasing members comprise one or more springs that facilitate movement of the offset mechanism.

22. The floor cleaning apparatus of claim 12 wherein in the offset position, the cleaning unit projects beyond only one lateral side of the floor cleaning apparatus.

* * * * *